US006864806B2

(12) United States Patent
Funayose et al.

(10) Patent No.: US 6,864,806 B2
(45) Date of Patent: Mar. 8, 2005

(54) DISPLAY APPARATUS FOR TRANSPORTATION MEANS

(75) Inventors: Yusuke Funayose, Saitama (JP); Toru Hasegawa, Saitama (JP); Tomohiko Yashiro, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 126 days.

(21) Appl. No.: 10/238,580

(22) Filed: Sep. 11, 2002

(65) Prior Publication Data

US 2003/0067384 A1 Apr. 10, 2003

(30) Foreign Application Priority Data

Sep. 18, 2001 (JP) ..... 2001-283563

(51) Int. Cl.[7] ..... G08B 23/00
(52) U.S. Cl. ..... 340/984; 440/2
(58) Field of Search ..... 340/984, 985, 340/425.5, 438, 439, 441, 517; 440/2, 84

(56) References Cited

U.S. PATENT DOCUMENTS 4,836,809 A * 6/1989 Pelligrino ..... 440/2
5,043,727 A * 8/1991 Ito ..... 340/984
5,941,188 A * 8/1999 Takashima ..... 114/55.5
6,029,639 A * 2/2000 Mashiko ..... 123/579
6,068,528 A * 5/2000 Suzuki ..... 440/1
6,250,976 B1 * 6/2001 Ozawa ..... 440/1
6,382,122 B1 * 5/2002 Gaynor et al. ..... 114/144 RE

FOREIGN PATENT DOCUMENTS

JP 9-169298 A 6/1997

* cited by examiner

*Primary Examiner*—Toan N. Pham
(74) *Attorney, Agent, or Firm*—Birch, Stewart, Kolasch & Birch, LLP

(57) ABSTRACT

A jet propulsion watercraft is provided with a multifunctional display portion that displays operating information and various types of warning conditions. Operation switches operate a content displayed in the multifunctional display portion. A fuel injection system injects fuel for a driving source. A warning mark warns of a faulty condition developing in the fuel injection system. Functions are provided that cause the warning mark to light steadily or flash off and on and that indicate a faulty symptom by means of a flashing pattern of a warning lamp (for example, the warning lamp flashes off and on once, twice, three time, or the like) given when the operation switches are operated while the warning mark is lit steadily or flashing off and on. A prompt action can be taken against a malfunction of the fuel injection system. As a result, convenience in eliminating malfunctions of the fuel injection system can be enhanced.

13 Claims, 17 Drawing Sheets

(A)
ST401..TURN ON MAIN SWITCH
ST402..PRESS AND HOLD DOWN ID NUMBER SWITCH FOR A WHILE
ST403..ENTER ID NUMBER
ST404..PRESS AND HOLD DOWN ID SET SWITCH FOR A WHILE
(B)
ST501..SET FUEL SIGNAL TO AN OPEN STATE
ST502..TURN ON MAIN SWITCH
ST503..PRESS BOTH MODE SWITCH AND SET SWITCH
ST504..ENTER RESET NUMBER
ST505..RESET ID NUMBER
ST506..TURN OFF MAIN SWITCH
ST507..SET FUEL SIGNAL TO A CLOSED STATE

FIG. 15(continued)

[FIG. 15]

ST601..PRESS AND HOLD DOWN ID NUMBER SWITCH FOR A WHILE

ST602..ENTER REGISTERED ID NUMBER

ST603..FLASH ID NUMBER OFF AND ON

ST604..PRESS AND HOLD DOWN ID SET SWITCH FOR A WHILE

ST605..IS ID NUMBER CHECKED OK?

ST606..ENTER NEW ID NUMBER

ST607..TURN ON BUZZER

ST608..CHECK NG DISPLAY

ST609..FLASH ID NUMBER OFF AND ON

ST610..PRESS AND HOLD DOWN ID SET SWITCH FOR A WHILE

ST611..DISPLAY ID NUMBER CHANGE COMPLETION

DISPLAY APPARATUS FOR TRANSPORTATION MEANS

CROSS-REFERENCE TO RELATED APPLICATIONS

This application claims priority under 35 U.S.C. §119 on Application No. 2001-283563, filed in Japan on Sep. 18, 2001, the entirety of which is hereby incorporated by reference.

BACKGROUND OF THE INVENTION

1. Field of the Invention

The present invention relates to a display apparatus for transportation means provided with a fuel injection system for injecting fuel in a drive source thereof. The transportation means refers to, for the purpose of this specification, overall means of transportation including watercrafts, aircrafts, railroads, and vehicles.

2. Description of Background Art

A display apparatus for transportation means has been known from, for example, Japanese Patent Laid-open No. Hei 9-169298 entitled "STARTING DEVICE FOR ALL WATERCRAFT."

In FIGS. 2 and 3 of the above document, a gage panel 6 control means E is provided with a meter 61 including a speedometer and a tachometer. A display portion 620 is provided that displays a stop watch, sailed time, and the like. A power source is connected to the gage panel 6 by way of an on-off switch 66 and to a starter motor 68 by way of a relay 67. Operation means 62 is provided for allowing the starter motor 68 to turn to let an engine 5 start when a password is entered therein. Furthermore, a mode switching button 610 is provided for selecting the mode of the display portion 620.

According to the starting device for a small watercraft, the meter 61 can display a sailing speed and the display portion 620 can display the sailed time and the like. It is also possible to select the mode of the display portion 620 using the mode switching button 610 and to enter the password or the like using the operation means 62. It would be convenient if such a display function and an operation function could be used to give a warning of a faulty condition of auxiliaries and discriminate a faulty symptom.

Namely, it is desirable that the display apparatus be capable of giving a warning against a faulty condition of the transportation means as well as displaying operating conditions thereof and be capable of discriminating a faulty symptom.

SUMMARY OF THE INVENTION

It is therefore an object of the present invention to provide a display apparatus that can not only display operating conditions of the transportation means, but also display faulty conditions and discriminate faulty symptoms.

To achieve the foregoing object, according to a first aspect of the present invention, a display apparatus for transportation means is provided with a multifunctional display portion that displays operating information and various types of warning conditions. Operation switches are provided that operate a content displayed in the multifunctional display portion. A fuel injection system is provided for injecting fuel for a driving source. Furthermore, a warning mark is provided in the multifunctional display portion that warns of a faulty condition developing in the fuel injection system, and functions are provided that cause the warning mark to light steadily or flash off and on and that indicate a faulty symptom by means of a flashing pattern of a warning lamp when the operation switches are operated while the warning mark is lit steadily or flashing off and on.

The fuel injection system is generally an apparatus that mixes air with fuel and vaporizes a mixture of air and fuel to supply the mixture to an engine. If the fuel injection system develops a faulty condition, for example, it is difficult to determine whether the fault is attributable to an air intake system, a fuel supply system, or any other system.

Accordingly, according to the present invention, a warning mark is provided that warns that a fault has occurred in the fuel injection system so that it is known that the fuel injection system has developed a fault. In addition, the warning mark is made to light steadily or flash off and on, emphasizing that the fault is present in the fuel injection system. Furthermore, there is provided a function that indicates a faulty symptom by means of a flashing pattern of a warning lamp when the operation switches are operated while the warning mark is lit steadily or flashing off and on, thereby allowing a prompt remedial action to be taken against a malfunction of the fuel injection system.

Namely, convenience in remedying a malfunction of the fuel injection system can be enhanced by providing the function that indicates a faulty symptom by means of a flashing pattern of the warning lamp when the operation switches are operated while the warning mark is lit steadily or flashing off and on.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
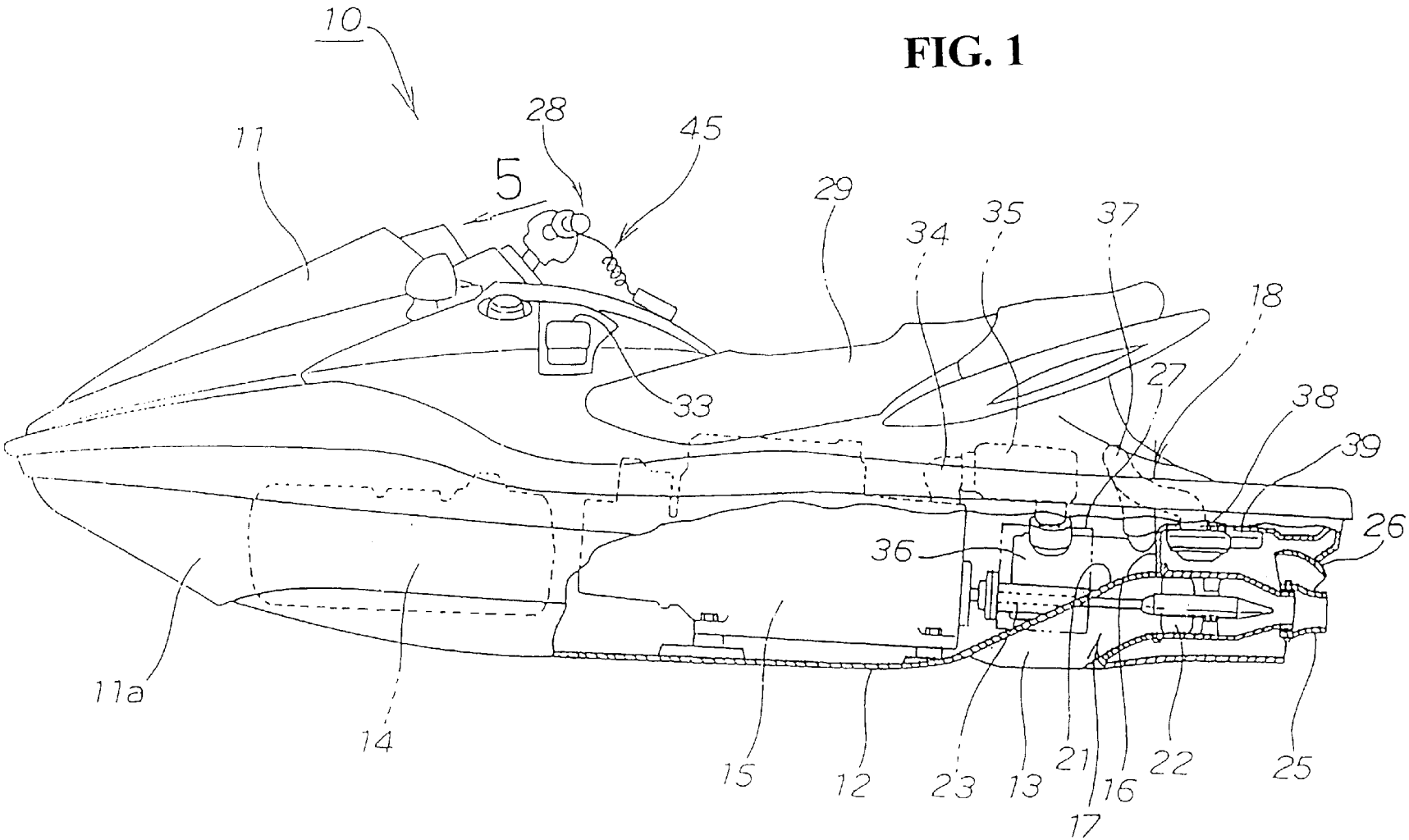
FIG. 1 is a side elevational view showing transportation means mounted with the display apparatus according to the present invention.

The present invention will now be described with reference to the accompanying drawings. The drawings should be viewed in the direction of the orientation of the reference numerals.

FIG. 1 is a side elevational view showing transportation means mounted with a display apparatus according to the present invention. A jet propulsion watercraft 10 is provided as an example of the transportation means according to the embodiment of the present invention. The jet propulsion watercraft is provided with a fuel tank 14 mounted at a front portion 11*a* of a hull 11. An engine 15 is provided rearward the fuel tank 14. A pump chamber 16 is provided rearward the engine 15. A jet propeller 17 is provided in the pump chamber 16. An exhaust unit 18 includes an intake side mounted in the engine 15 and an exhaust side mounted in the pump chamber 16. A steering handle 28 is mounted upward of the fuel tank 14, and a seat 29 is mounted rearward of the steering handle 28.

The jet propeller 17 is provided with a housing 21 that extends rearward from an opening 13 in a hull bottom 12. An impeller 22 is rotatably mounted in the housing 21 and coupled to a driving shaft 23 of the engine 15.

According to the jet propeller 17, the engine 15 is driven to rotate the impeller 22. The impeller 22 allows water drawn in through the opening 13 in the hull bottom 12 to be injected rearward the hull body 11 from a steering pipe 25, which acts as a nozzle by way of an opening at a rear end of the housing 21.

The steering pipe 25 is a member mounted at the rear end of the housing 21 so as to be swung to a left and a right. The steering pipe 25 serves as a steering nozzle that controls a direction of travel of the hull 11 as it is swung to the left or the right when the steering handle 28 is operated.

According to the jet propulsion watercraft 10, it is possible to propel the watercraft as follows. Namely, fuel is supplied from the fuel tank 14 to the engine 15 to drive the same. The driving force of the engine 15 is transmitted through the driving shaft 23 to the impeller 22 to turn the same. By turning the impeller 22, water is drawn in through the opening 13 in the hull bottom 12 and then expelled from the steering pipe 25 through the rear end of the housing 21 to provide the watercraft 10 with a propulsion force.

The jet propulsion watercraft 10 is provided, as will be described below, with a control portion for accurately controlling the amount of the water jet or the period of time through which the water jet is expelled. In addition, it is also capable of selecting a limited operation mode, in which an engine output is limited within a predetermined level of output.

Referring to FIG. 1, reference numeral 26 represents a reverse bucket that is placed over the steering pipe 25 to allow the water jet to flow obliquely forwardly and downwardly when the watercraft is to be reversed. Reference numeral 33 represents a operation knob for operating the reverse bucket 26. Reference numeral 34 represents an exhaust pipe. Reference numeral 35 represents an exhaust body. Reference numeral 27 represents a battery that serves as a power source for the hull 11. Reference numeral 36 represents a water muffler. Reference numeral 37 represents a water lock pipe. Reference numeral 38 represents a tail pipe. Reference numeral 39 represents a resonator. Reference numeral 45 represents a main switch with a lanyard switch.

Figure 2:
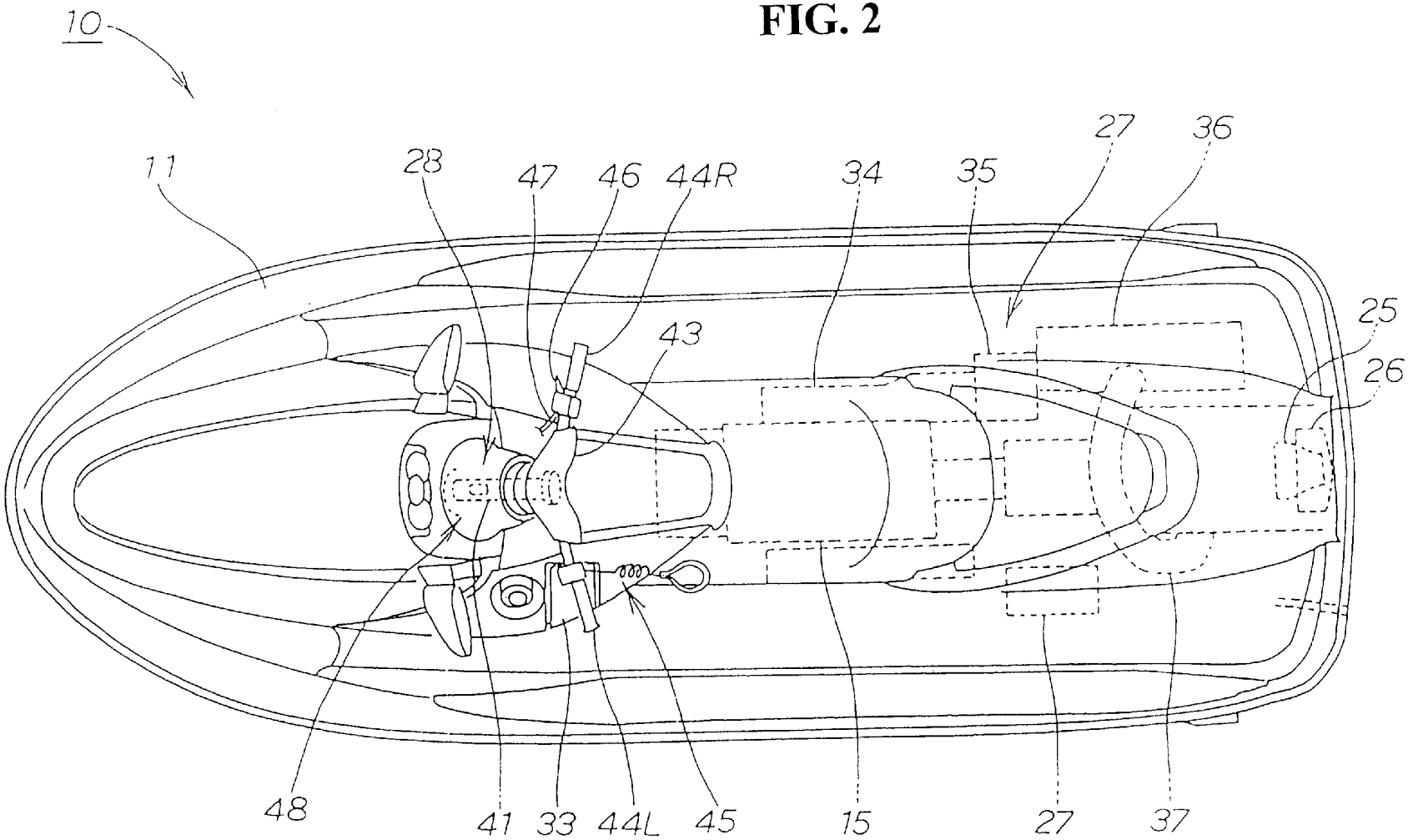
FIG. 2 is a plan view showing the transportation means mounted with the display apparatus according to the present invention.

FIG. 2 is a plan view showing the transportation means mounted with the display apparatus according to the embodiment of the present invention. The steering handle 28 is provided with a steering shaft 41 mounted rotatably in the hull. A handlebar 43 is mounted on an upper end of the steering shaft 41. Left and right handle grip 44L and 44R are attached on left and right end portions, respectively, of the handlebar 43. The main switch 45 with the lanyard switch is provided at a root of the left handle grip 44L. A throttle lever 46 is mounted at a root of the right handle grip 44R so as to be freely swung therein. A throttle cable 47 extends from the throttle lever 46 to a throttle. A steering action detection mechanism 48 is provided at a lower end of the steering shaft 41.

Figure 3:
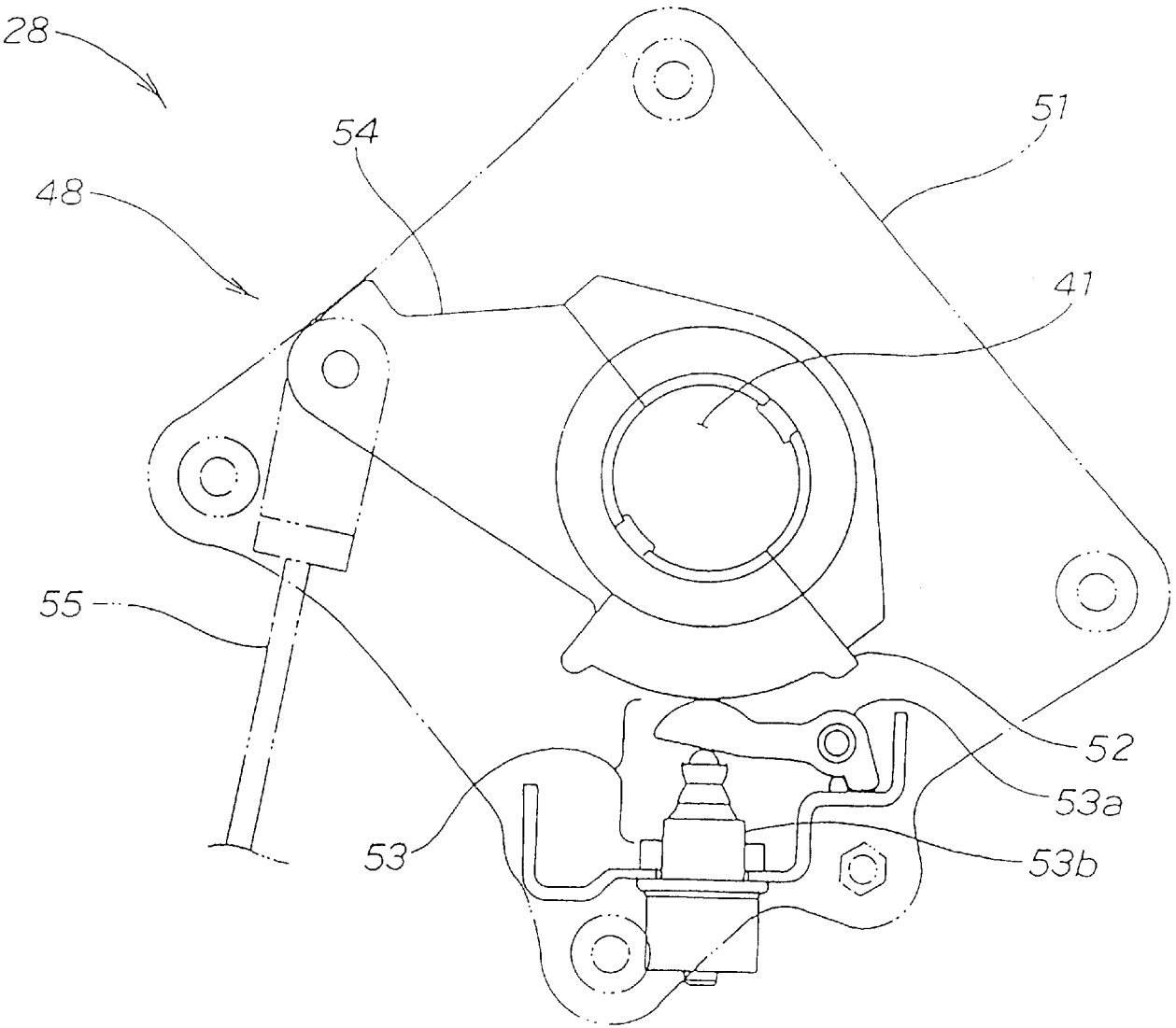
FIG. 3 is a plan view showing the steering mechanism of the transportation means mounted with the display apparatus according to the present invention.

FIG. 3 is a plan view showing a steering mechanism of the transportation means mounted with the display apparatus according to the embodiment of the present invention. The steering action detection mechanism 48 is provided with a bracket 51 fitted to the hull 11 (see FIG. 1). A switch cam 52 is mounted at the lower end of the steering shaft 41. A steering action switch 53 is turned ON or OFF by the switch cam 52. A cam plate 54 is mounted at the lower end of the steering shaft 41. Reference numeral 55 represents a driving link that is mounted rotatably at an end portion of the cam plate 54 so as to drive the steering pipe 25 (see FIG. 1). Reference numeral 53*a* represents a switch lever of the steering action switch 53. Reference numeral 53*b* represents a main body portion of the steering action switch 53.

Figure 4:
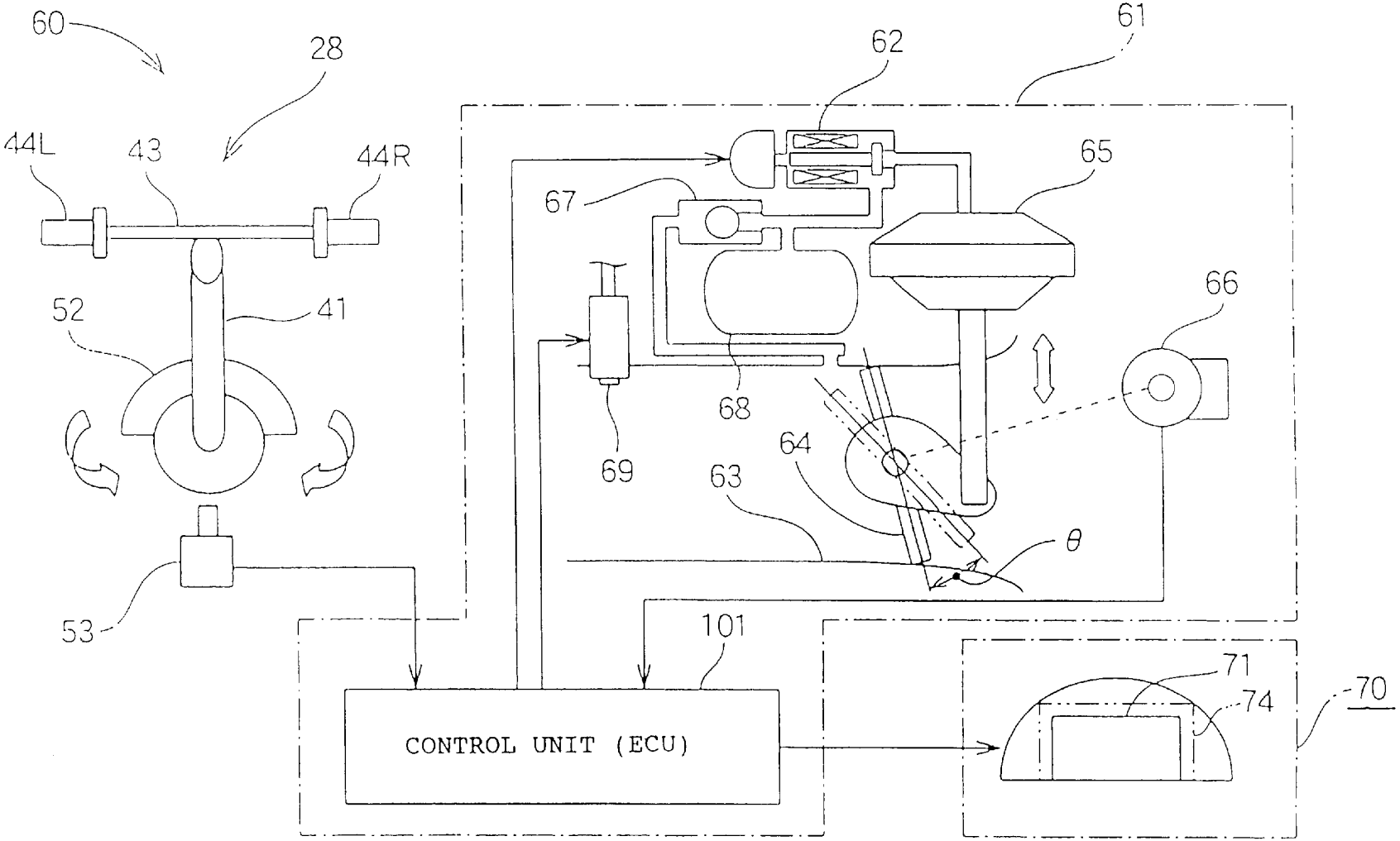
FIG. 4 is a block diagram of the OTS control system for the transportation means mounted with the display apparatus according to the present invention.

FIG. 4 is a block diagram of an OTS control system for the transportation means mounted with the display apparatus according to the embodiment of the present invention. The OTS is an acronym for Off Throttle Steering system that maintains a predetermined rate of a water jet for a brief period of time even when a throttle 64 is returned.

An OTS control system 60 of the jet propulsion watercraft is provided with the steering handle 28 that steers the hull 11 (see FIG. 1). The fuel injection system 61 is provide to supply the engine 15 (see FIG. 1) with fuel. A control portion (ECU) 101 controls the hull 11. A display apparatus 70 is provided with a display control portion 74 functioning as a control unit for displaying conditions of the hull 11. The system closes the throttle 64 when the engine 15 turns at a predetermined speed or more for a predetermined period time or more and the throttle 64 remains open to a predetermined angle or more for a predetermined period of time or more. It also increases the speed of the engine 15 to a predetermined value regardless of the position of the throttle 64, if the steering handle 28 is turned to a predetermined angle or more clockwise or counterclockwise.

The fuel injection system 61 is provided with a solenoid 62 that controls vacuum based on information provided by the control portion (ECU) 101. The throttle 64 is disposed in an intake passageway 63 and adjusts the amount of air-fuel mixture supplied to the engine 15 (see FIG. 1). A diaphragm 65 is disposed between the solenoid 62 and the throttle 64 and adjusts the throttle opening. A throttle sensor 66 detects the throttle opening. A one-way valve 67 is disposed between the solenoid 62 and the intake passageway 63 and prevents a counterflow of vacuum and entry of pressure. A surge tank 68 is disposed between the one-way valve 67 and the solenoid 62 and lessens fluctuations in the vacuum. An injector 69 atomizes fuel and supplies a fine fuel mist into the intake passageway 63. The symbol θ in the figure represents a throttle opening.

Figure 5:
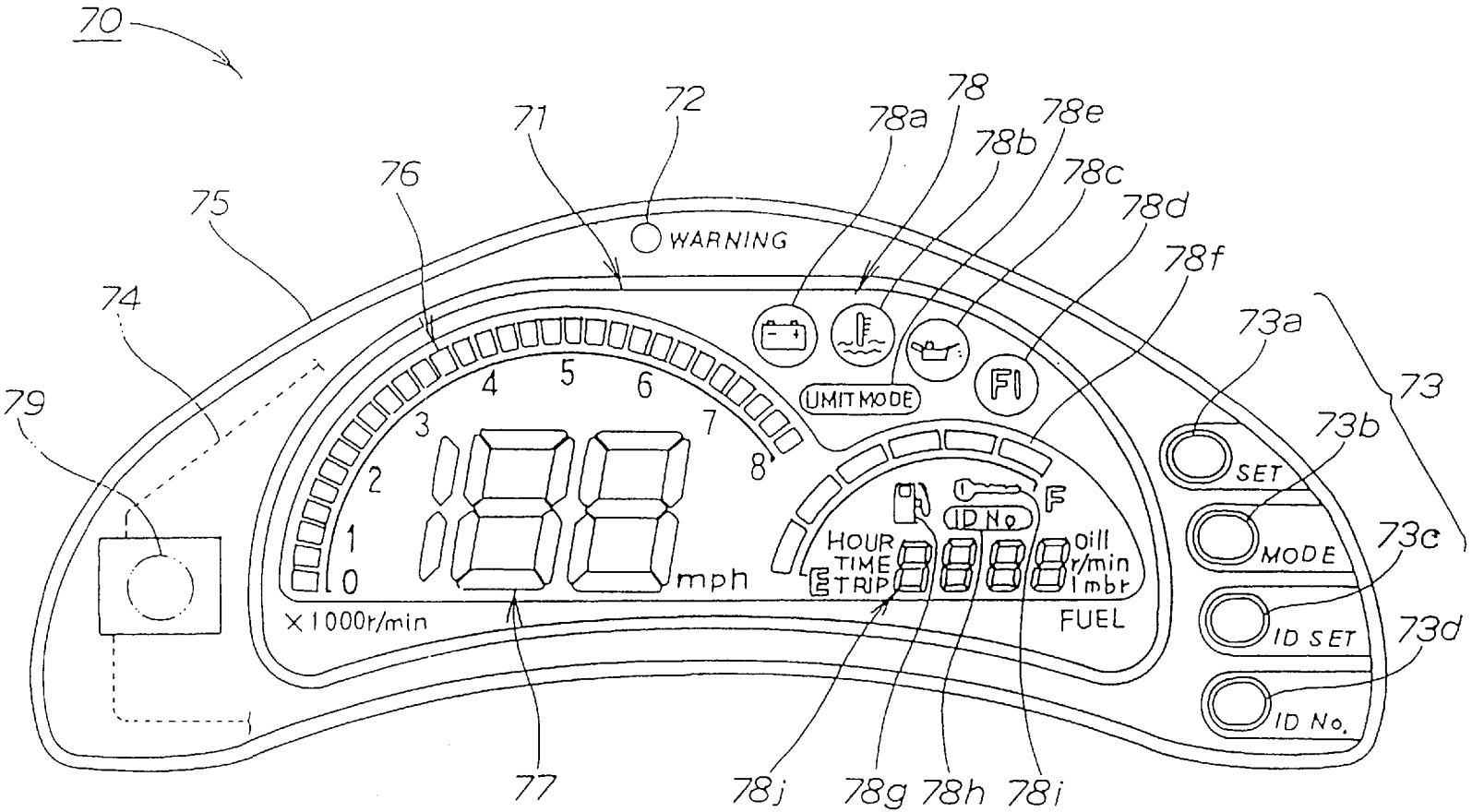
FIG. 5 is a perspective view taken in the direction of arrow 5 of FIG. 1.

FIG. 5 is a perspective view taken in the direction of arrow 5 of FIG. 1, showing a front face of the display apparatus 70 of the jet propulsion watercraft (hereinafter abbreviated simply to the "display apparatus 70").

The display apparatus 70 is provided with a liquid crystal device 71 as a liquid crystal display portion displaying operating information. A warning lamp 72 lights steadily or flashes off and on when a corresponding warning need to be issued. Operation switches 73 are provided for selecting a function and entering data. A display control portion 74 drives the liquid crystal device 71 and the warning lamp 72. In addition, the control portion 74 controls the hull 11. A housing 75 collectively covers the liquid crystal device 71, the warning lamp 72, and the display control portion 74. A buzzer 79 produces a warning sound when the warning lamp 72 is turned on or flashed off and on.

The liquid crystal device 71 is provided with a tachometer that displays the speed of the engine 15(see FIG. 1), a speedometer 77 that displays the sailing speed, and a multifunctional display portion 78 that displays operating information and various types of warning conditions, all formed thereon.

The multifunctional display portion 78 is provided with a charging mark 78*a* that flashes off and on when the voltage of the battery 27 (see FIG. 1) decreases below a predetermined level. A coolant temperature warning mark 78*b* flashes off and on when the temperature of the coolant exceeds a predetermined level. An oil warning mark 78*c* flashes off and on when the amount of the engine oil or the pressure of the engine oil becomes lower than a predetermined level. A fuel injection system warning mark 78*d* (hereinafter abbreviated to the "FI warning mark 78*d*") flashes off and on when the fuel injection system 61 (see FIG. 3) develops a faulty condition. A limit mode indicator mark 78*e* functions as an indicator indicating that the limited operation mode, in which the engine output is limited within a predetermined level of output, is selected. A fuel level indicator 78*f* indicates the level of fuel still available for use. A refueling warning mark 78*g* prompts a driver to refuel the watercraft when fuel is running out. An ID number mark 78*h* flashes off and on when an ID (identification) number, as a password for an anti-theft function, has been set and locked. A key mark 78*i* lights steadily when the anti-theft function is canceled. A selective display portion 78*j* selectively displays the time-of-day, sailed time, engine speed (hereinafter abbreviated to the "Ne tachometer display"), sailed distance, or cumulative sailed time.

Namely, the jet propulsion watercraft 10 (see FIG. 1) is also provided with an anti-theft function that can turn the power ON or OFF by simply entering the ID number.

The operation switches 73 are provided with a set switch 73*a* used to set the time-of-day and the like, a mode switch 73*b* used to select a specific function of the selective display portion and set the limited operation mode, an ID set switch 73*c* used to enter and validate the ID number, and an ID number switch 73*d*.

Figure 6:
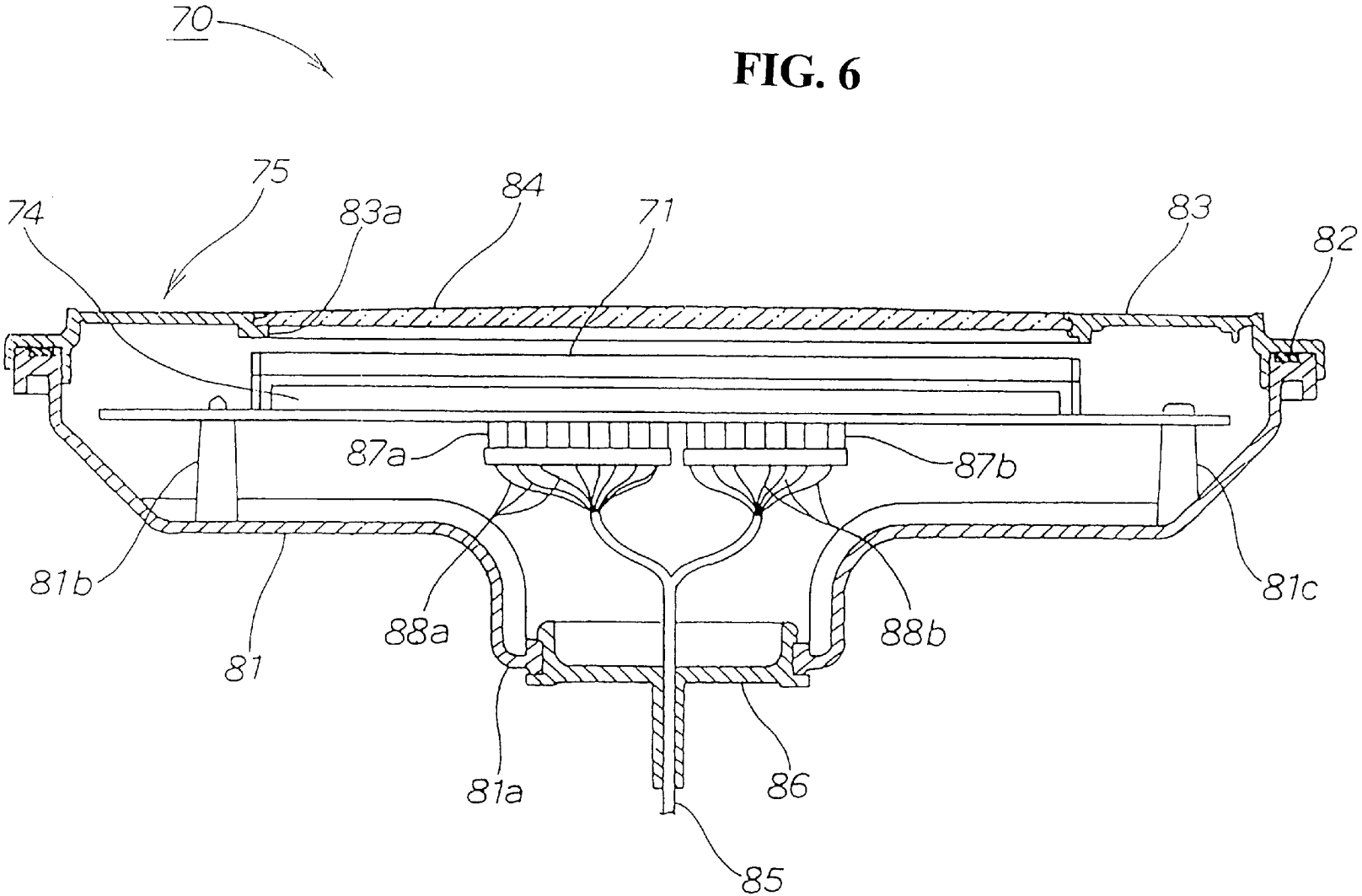
FIG. 6 is a plan cross-sectional view showing the display apparatus of the transportation means mounted with the display apparatus according to the present invention.

FIG. 6 is a plan cross-sectional view showing the display apparatus of the transportation means mounted with the display apparatus according to the embodiment of the present invention. The housing 75 is provided with a lower case 81, to which the display control portion 74 is mounted. An upper case 83 is mounted to the lower case 81 by way of a packing 82. A display window 84 is mounted in an opening 83*a* in the upper case 83. A bushing 86 is provided for extracting a bundle of harnesses 85 through a bottom 81*a* of the lower case 81.

Reference numeral 81*b* represents a boss that is placed onto the lower case 81 to support the display control portion 74. Reference numeral 81*c* represents a restraint boss that is placed onto the lower case 81 to stop the display control portion 74. Reference numerals 87*a*, 87*b* represent connectors connected to the display control portion 74. Reference numerals 88*a*, 88*b* represent a plurality of harnesses extended from the display control portion 74.

Figure 7:
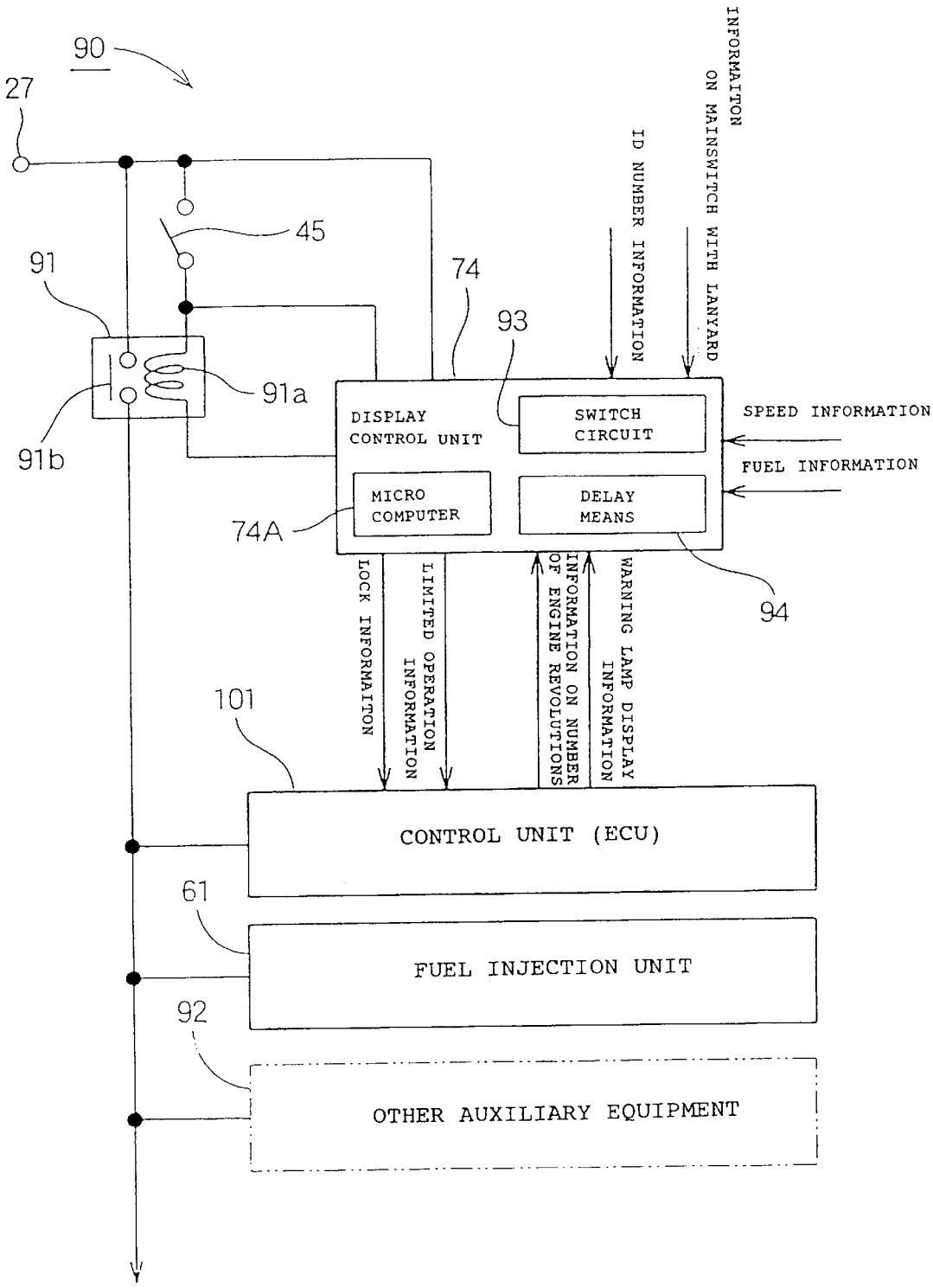
FIG. 7 is a block diagram of the power supply system for the transportation means mounted with the display apparatus according to the present invention.

FIG. 7 is a block diagram of a power supply system for the transportation means mounted with the display apparatus according to the embodiment of the present invention. A power supply system 90 is provided with the main switch 45 with the lanyard switch that is connected in parallel with a battery 27 power source. A main relay 91 turns the battery 27 power source ON or OFF. The power source is supplied to the fuel injection system 61 and other auxiliaries 92 (fuel pump to be described later) by connecting a coil portion 91*a* in series with the main switch 45 and connecting a switch portion 91*b* in series with the battery 27. The display control portion 74 is connected in parallel with the main switch 45 so as to control the main relay 91. The control portion (ECU) 101 controls the engine 15 (see FIG. 1) having the fuel injection system 61 and the like.

The control portion (ECU) 101 controls the jet propulsion watercraft 10 (see FIG. 1) that controls the fuel injection system 61 and other auxiliaries 92, in addition to the engine 15.

The display control portion 74 is provided with a microprocessor 74A that forms the core thereof A switch circuit 93 turns the power source of the display control portion 74 ON or OFF when the information of the main switch 45 with the lanyard switch and the predetermined ID number are entered. Delay means 94 delays the operation of the switch circuit 93 for a predetermined period of time. It is for entering the anti-theft ID information, the information of the main switch with the lanyard switch, hull speed information, fuel information for display of the amount of fuel still available for use, engine speed information, the information for the multifunctional display portion 78 and warning lamp display information shown in FIG. 5, and the like, and for outputting the limited operation information when a limited operation is executed by controlling the fuel injection system 61 (see FIG. 4), lock information that keeps the main relay 91 OFF, and the like. Reference numeral 92 represents other auxiliaries.

The power supply system 90 may be summarized as follows. That is, the power supply system 90 is provided with the main switch 45 with the lanyard switch that is connected to the operator through a wire to allow the power to be turned OFF in emergencies. It is a power supply system for a small watercraft that supplies the auxiliaries including the fuel injection system 61 with power and is provided with the control portion that controls the engine. The power supply system 90 further provided with the main relay 91 that turns ON or OFF the power supplied to the auxiliaries and is further provided with the control unit (display control portion 74) that is connected in parallel with the main switch 45 so as to control the main relay 91, thereby monitoring the ON or OFF condition of the main switch 45 by means of the control unit (display control portion 74) and providing ON/OFF control of the main relay 91 based on the ON or OFF condition monitored.

Since the main relay 91 is provided for turning ON or OFF the power supplied to the auxiliaries including the fuel injection system 61, the control unit (display control portion 74) connected in parallel with the main switch 45 is provided for controlling the main relay 91. In addition, the arrangement is provided, in which the ON or OFF condition of the main switch 45 is monitored by the control unit (display control portion 74) and the main relay 91 is turned ON or OFF according to the ON or OFF condition of the main switch 45. Accordingly, it is possible to provide a single-source control for turning ON or OFF the power supplied to the auxiliaries including the fuel injection system 61. As a result, the power supply system 90 can be even more simplified.

The display control portion 74 provides an output of the lock information indicating that the main relay 91 is OFF for the control portion (ECU) 101. Since the lock information is available at the control portion (ECU) 101, therefore, the engine 15 (see FIG. 1) cannot be started even with the main relay 91 directly connected.

Namely, the power supply system 90 is provided with an anti-theft function in the control unit (display control portion 74) thereof and, if the control portion (ECU) 101 produces an output of information to turn OFF the main relay 91 from the control unit (display control portion 74), it provides an output of a stop signal to stop the engine 15 based on the information to turn OFF the main relay 91.

The arrangement, in which, when an output of the information to turn OFF the main relay 91 is produced from the control unit (display control portion 74), it causes an output of the stop signal to stop the engine 15 to be provided based on the information to turn OFF the main relay 91, prevents the engine 15 from being started even when, for example, the main relay 91 is directly connected. The anti-theft feature of the small watercraft (jet propulsion watercraft 10) can thus be even more enhanced.

Figure 8:
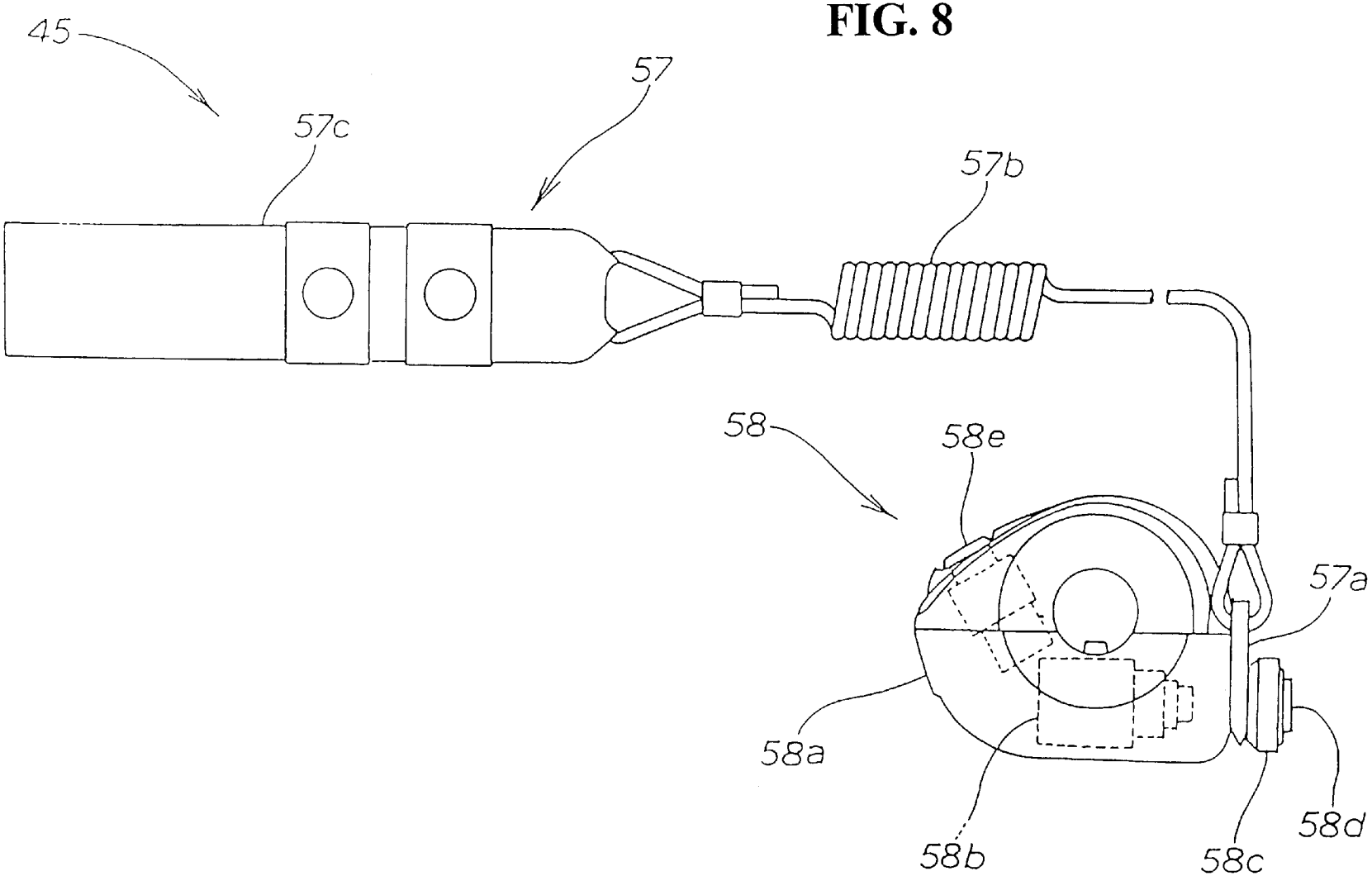
FIG. 8 is a side elevational view showing the main switch with the lanyard switch of the transportation means mounted with the display apparatus according to the present invention.

FIG. 8 is a side elevational view showing the main switch with the lanyard switch of the transportation means mounted with the display apparatus according to the embodiment of the present invention. The main switch 45 with the lanyard switch is provided with a lanyard switch portion (switch operating strap) 57 connected to the operator during sailing and a main switch main body portion 58 that can turn the lanyard switch ON or OFF.

The lanyard switch portion 57 is provided with a clip portion 57*a* that turns the power ON or OFF when it is pinched in or removed from the main switch main body portion 58. A wire 57*b* extends from the clip 57*a* and is extendable. A hand strap 57*c* is fitted to a leading edge of the wire 57*b* and is worn by the operator on the operator's arm.

The main switch portion 58 is provided with a housing 58*a* fitted to the hull 11 (see FIG. 1). A switch 58*b* is housed in the housing 58*a*. An outer knob 58*c* operates the switch 58*b*. A stop button 58*d* is provided inside the outer knob 58*c*. A start switch 58*e* starts the engine 15 (see FIG. 1).

The switch works as follows. The switch 58*b* is turned ON when the outer knob 58*c* is pulled outwardly, kept in the ON position when the clip 57*a* of the lanyard switch portion 57 is inserted, and is automatically returned to an initial position of OFF when the clip 57*a* is disengaged. The power is turned OFF when the stop button 58*b* is pressed with the clip 57*a* pinched in position. The function of the main switch 45 with the lanyard switch will now be explained in detail.

Figure 9A:
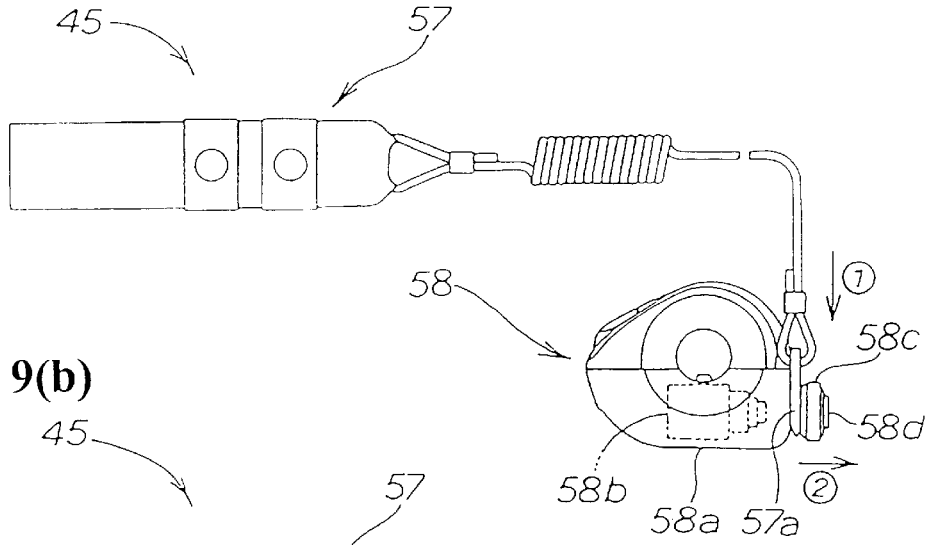
FIGS. 9(*a*) through 9(*c*) are illustrations explaining the function of the main switch with the lanyard switch employed in the transportation means mounted with the display apparatus according to the present invention.
Figure 9B:
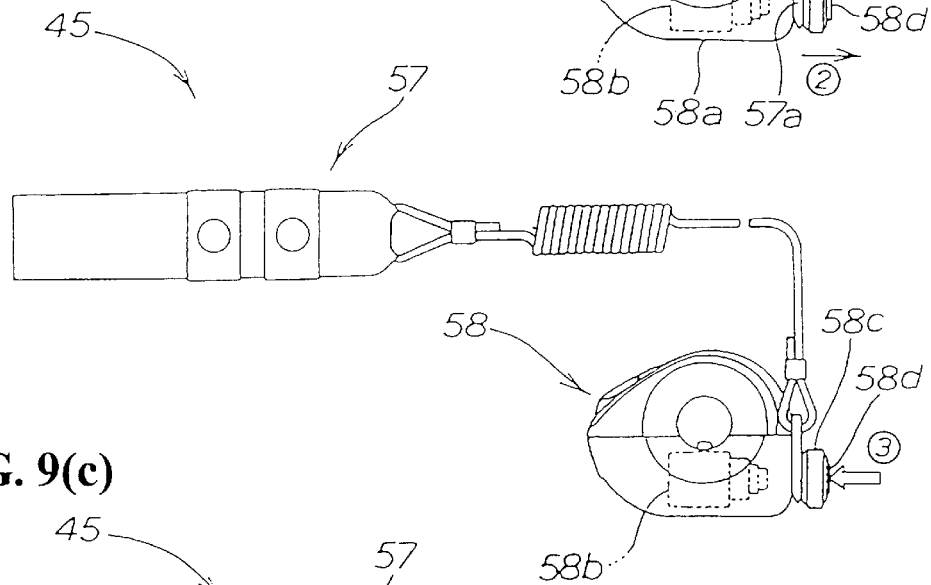
Figure 9C:
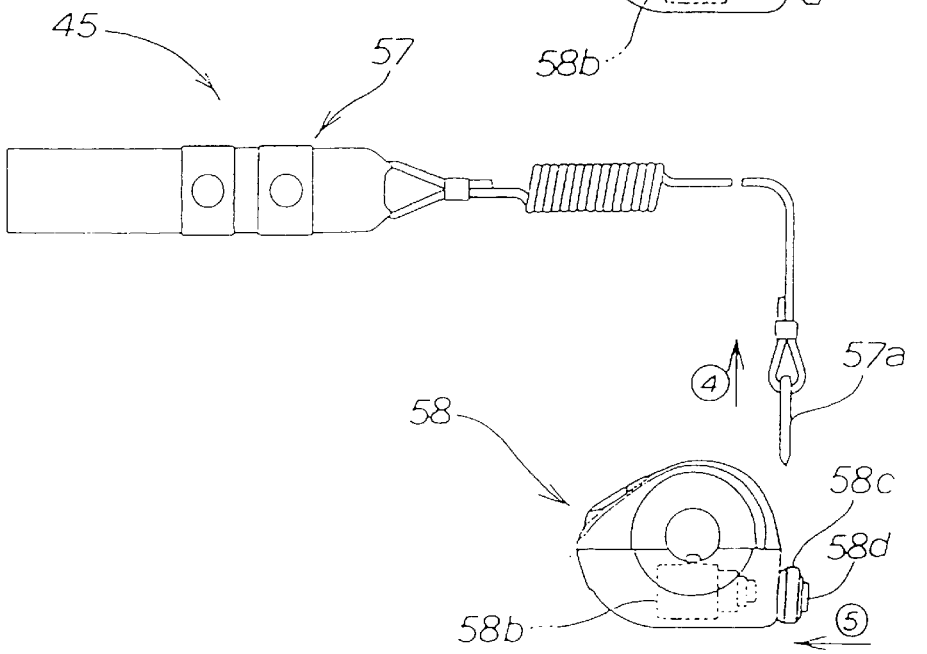

FIGS. 9(*a*) through 9(*c*) are illustrations explaining the function of the main switch with the lanyard switch employed in the transportation means mounted with the display apparatus according to the embodiment of the present invention.

Referring to FIG. 9(*a*), pushing the clip 57*a* of the lanyard switch portion 57 in the direction of the arrow ① into a space between the housing 58*a* and the outer knob 58*c* of the main switch main body portion 58 moves the outer knob 58*c* in the direction of the arrow ②, turning the switch 58*b* ON.

Referring to FIG. 9(*b*), pushing the stop button 58*d* in the direction of the arrow ③ with the lanyard switch portion 57 fitted in the main switch main body portion 58 turns the switch 58*b* to the OFF position.

Referring to FIG. 9(*c*), pulling the clip 57*a* of the lanyard switch portion 57 in the direction of the arrow ④ from the space between the housing 58*a* and the outer knob 58*c* of the main switch main body portion 58 returns the outer knob 58*c* and the stop button 58*d* automatically in the direction of the arrow ⑤, thus turning the main switch main body portion 58 OFF.

Figure 10A:
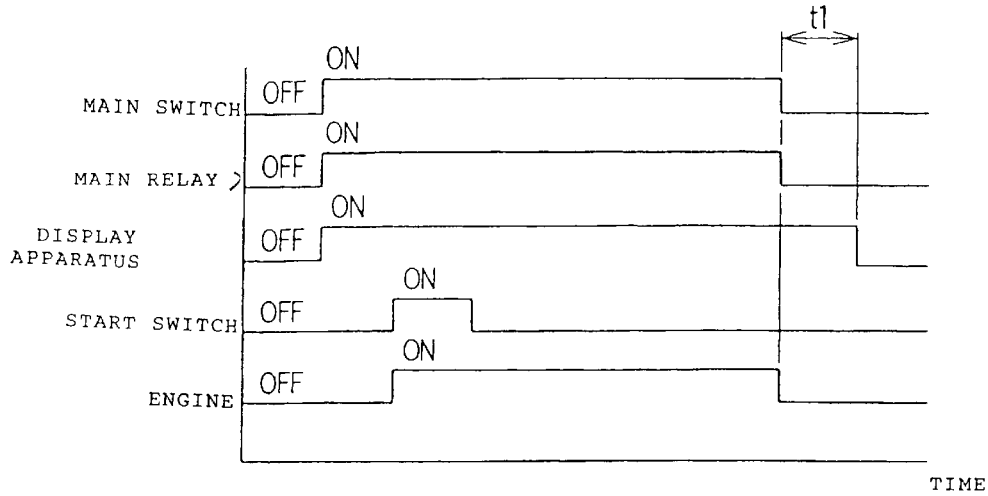
FIGS. 10(*a*) through 10(*c*) are illustrations explaining the function of the power supply system employed in the transportation means mounted with the display apparatus according to the present invention.
Figure 10B:
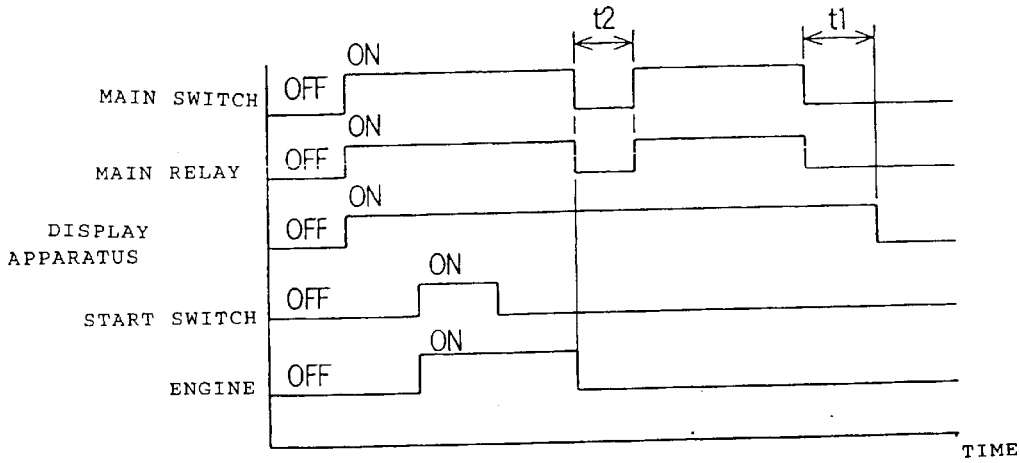
Figure 10C:
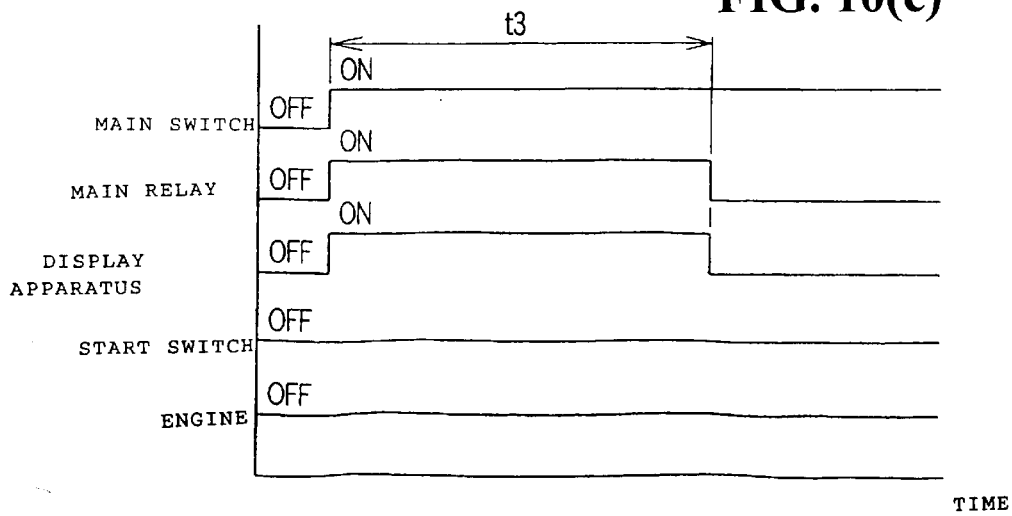

FIGS. 10(*a*) through 10(*c*) are illustrations explaining the function of the power supply system employed in the transportation means mounted with the display apparatus according to the embodiment of the present invention. FIGS. 10(*a*) through 10(*c*) show the relationship of the operating conditions of the main relay, display apparatus, start switch, and the engine.

FIG. 10(*a*) shows the operations performed when the lanyard switch 57 is removed, or, at the end of sailing or at a turnover.

As explained in FIGS. 9(*a*) through 9(*c*), fitting the lanyard switch portion 57 into the main switch main body portion 58 turns the main switch 45, the main relay 91 (see FIG. 7), and the display apparatus 70 (see FIG. 4) to the ON position in synchronism with each other. Pressing the start switch 58*e* (see FIG. 8) then starts the engine 15 (see FIG. 1).

When the lanyard switch 57 is then removed from the main switch main body portion 58, the main switch 45, the main relay 91, and the engine 15 are set to the OFF condition in synchronism with each other. The display apparatus 70 is set to the OFF condition after a lapse of a predetermined period of time t1 (as controlled by the delay means 94 provided for the display control portion 74 as shown in FIG. 7). The predetermined period of time t1 is set to 10 seconds in this embodiment.

FIG. 10(*b*) shows the operations performed when the engine 15 is stopped without the lanyard switch 57 being removed, i.e., in cases where the operator sits on the seat in a standby state, the stop button 58*d* is pressed to turn OFF the main switch 45, and within the period of time t2, the main switch 45 is turned ON (t2<t1). As shown in FIG. 10(*a*), since an arrangement is provided to allow the display apparatus 70 to maintain the ON condition for a period of time t1 after the main switch 45 has been turned OFF, only the engine 15 is stopped through the above operation, while allowing the display apparatus 70 to stand by and maintain the ON condition. The display control portion 74 provided for the display apparatus 70 enters a fault check mode when the display apparatus 70 is turned ON. As a result, the display apparatus 70 requires time to start. Therefore, the engine 15 is stopped to enter the standby state so as to allow the watercraft to start sailing immediately when the start switch 58*e* is then pressed.

FIG. 10(*c*) shows the operations performed when the main switch is left to stand without the lanyard switch 57 being removed.

When a predetermined period of time t3 elapses with the engine 15 in the OFF condition and the main switch 45, the main relay 91, and the display apparatus 70 in the ON condition, an arrangement is provided in the display control portion 74 so that the main relay 91 and the display apparatus 70 are automatically turned OFF (as controlled by the switch circuit 93 provided for the display control portion 74 shown in FIG. 7), thereby curtailing unnecessary power consumption of the battery 27 (see FIG. 1).

The power supply system 90 (see FIG. 7) may be said to ensure that, when the main switch 45 is turned from the ON condition to the OFF condition, the main relay 91 is instantaneously turned from ON to OFF and the control unit (display control portion 74) maintains the ON condition for a predetermined period of time during which the main switch 45 remains the OFF condition.

For example, the control unit is commonly made to perform fault diagnostics procedures for the display apparatus and auxiliaries when the power is turned ON. Shutting down the power for the control unit accidentally results in the control unit taking time to start.

The control unit is therefore made to maintain the ON condition for a predetermined period of time during which the main switch remains in the OFF condition. The main switch 45 (see FIG. 7) is switched to the OFF condition and the main relay 91 is instantaneously switched to OFF, thereby shutting down the supply of power to the auxiliaries including the fuel injection system 61 and temporarily stopping the jet propulsion watercraft 10 (see FIG. 1). In this temporary stop condition, the control unit (display control portion 74) can maintain an active condition, allowing the watercraft to shift from the temporary stop condition to a state ready to start sailing immediately within a short period of time. This enhances the convenience of the jet propulsion watercraft 10.

Figure 11:
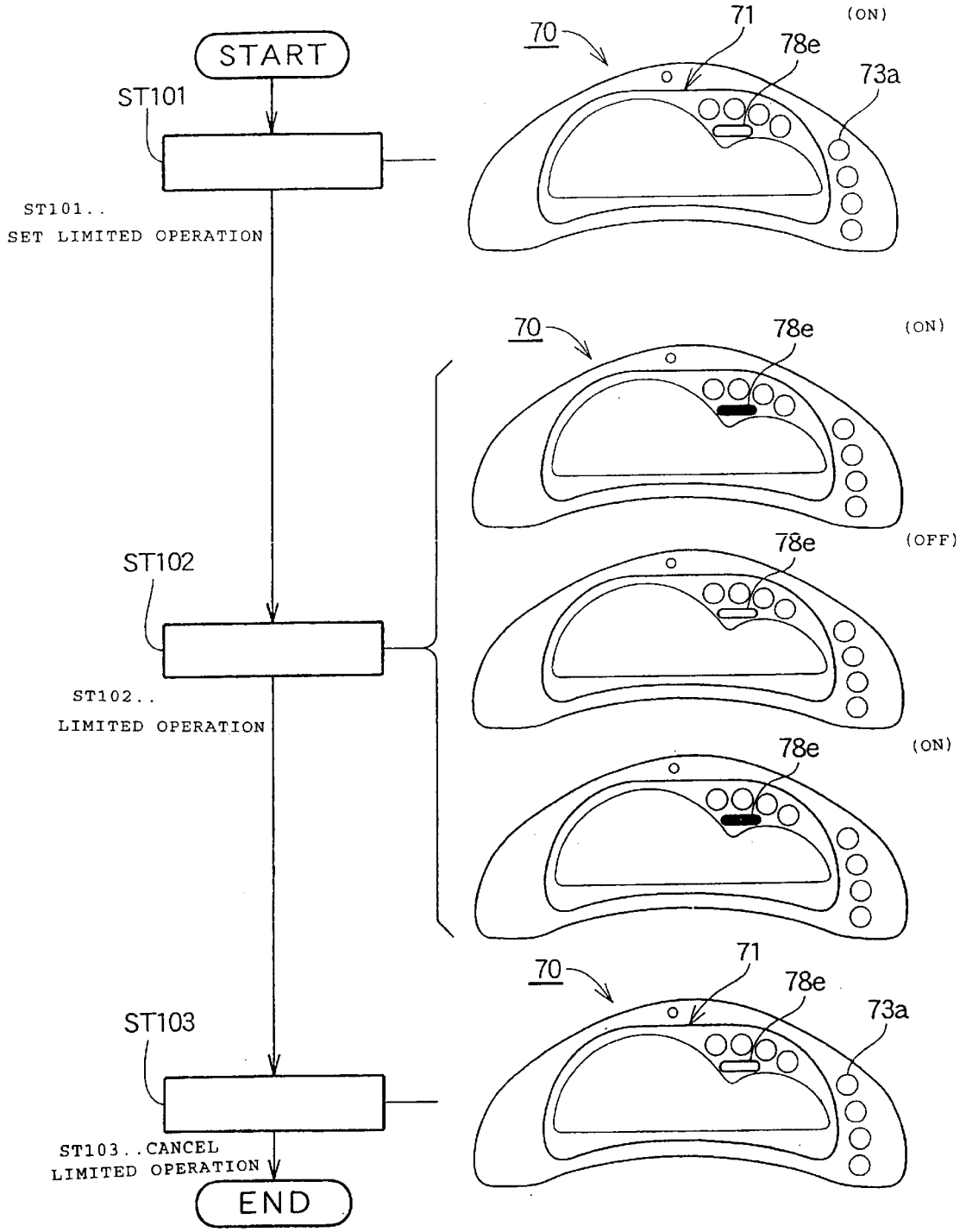
FIG. 11 is a flow chart showing steps involved in setting the limited operation for the transportation means mounted with the display apparatus according to the present invention.

FIG. 11 is a flow chart showing the steps involved in setting the limited operation for the transportation means mounted with the display apparatus according to the embodiment of the present invention. STX$^{xxx}$ represents a step number.

ST101: The limited operation mode, in which the output of the engine 15 (see FIG. 1) is limited to a low level, is set. More specifically, the set switch 73*a* of the display apparatus 70 is pressed and held down for a while. Pressing and holding down the switch for a while refers to the action, in which the set switch 73*a* is held pressed for a continuous period of 5 seconds or more. The set switch 73*a* functions also as a function setting switch for setting the time-of-day and the like.

Namely, setting the limited operation causes the limit mode indicator mark 78*e* to light steadily.

ST102: During the limited operation, the limit mode indicator mark 78*e* flashes off and on to indicate that the output of the engine 15 is limited by the limited operation.

ST103: The limited operation is canceled. More specifically, the set switch 73*a* of the display apparatus 70 is pressed and held down for a while. The limit mode indicator mark 78*e* goes out.

The display apparatus 70 may be provided in the display panel (liquid crystal device 71) thereof, with an indicator lamp (limit mode indicator mark 78*e*) that lights steadily when the limited operation is selected. The display apparatus 70 is provided in the small watercraft (jet propulsion watercraft 10), which is provided with a display panel (liquid crystal device 71) that displays operating information and a selector switch (set switch 73*a*), with which an ordinary operation can be switched to a limited operation. IN the ordinary operation, the output of the engine 15 is not limited. In the limited operation, the output of the engine 15 is limited to a low level.

For example, suppose that the throttle 64 (see FIG. 4) is opened to increase the sailing speed when the small watercraft (jet propulsion watercraft 10), which can be switched from the ordinary operation to the limited operation, is operated in the limited operation. If the operator is not being aware, at this time, of the fact that the small watercraft (jet propulsion watercraft 10) is being operated in the limited operation, he or she may mistake it for a malfunction of the small watercraft (jet propulsion watercraft 10). Convenience of the operator is therefore enhanced if the indicator lamp (limit mode indicator mark 78*e*) that indicates that the ordinary operation has been switched to the limited operation is provided.

The display apparatus 70 may also make the indicator lamp (limit mode indicator mark 78*e*) flash off and on in the limited operation; namely, when the output of the engine 15, which has exceeded a predetermined level, is being limited.

Making the indicator lamp (limit mode indicator mark 78*e*) flash off and on during the limited operation allows the operator to be even more aware that the transportation means is in the limited operation.

The display apparatus 70 may further be said to be provided with the selector switch (set switch 73*a*) that functions also as a function selector switch for the display panel (liquid crystal device 71).

Operation functions can be made to be even more multifunctional by allowing the selector switch (set switch 73*a*) to function also as the function selector switch for the display panel (liquid crystal device 71). This contributes to making the display apparatus 70 even more compact.

Figure 12:
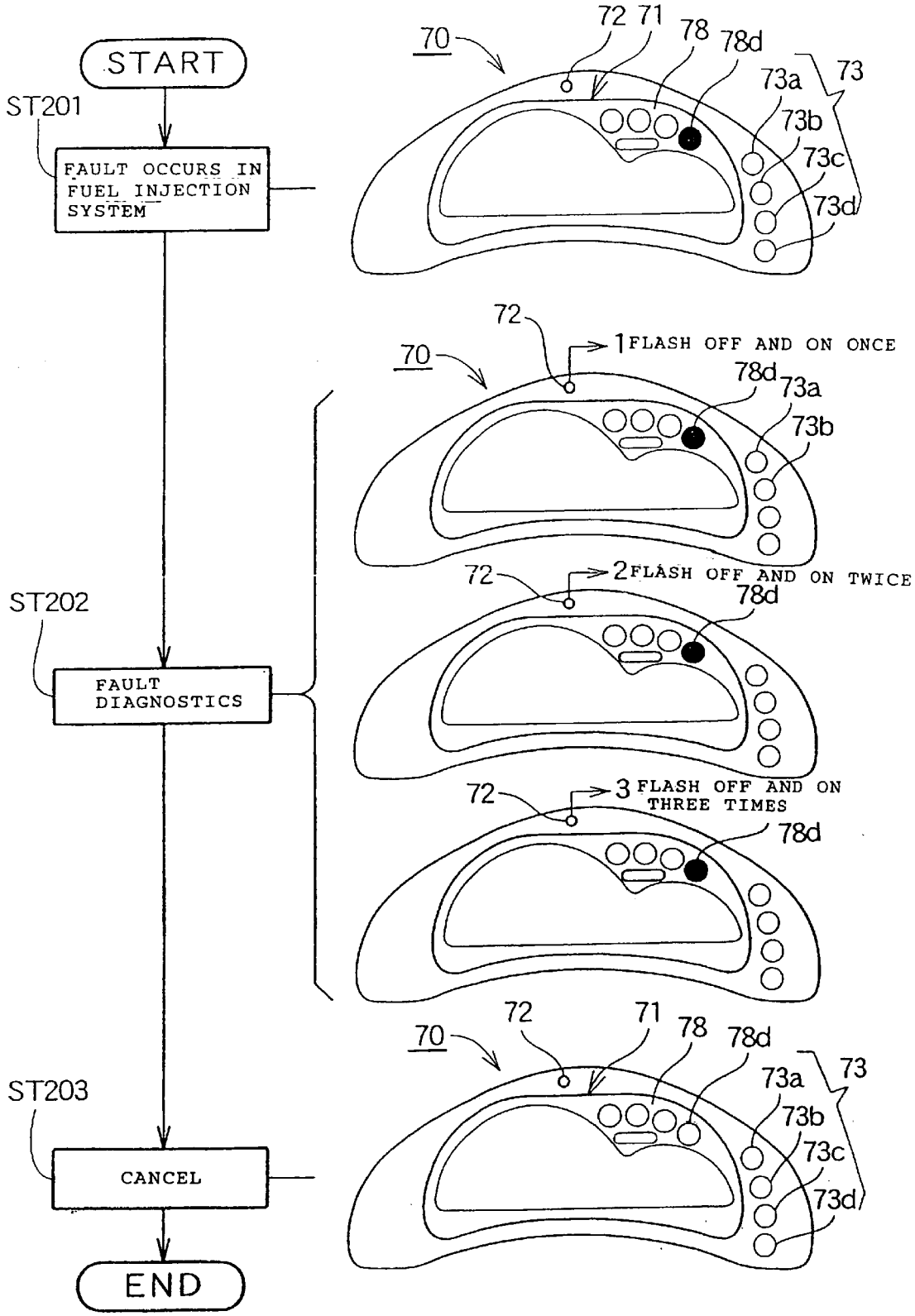
FIG. 12 is a flow chart showing steps involved in fault diagnostics procedures for the transportation means mounted with the display apparatus according to the present invention.

FIG. 12 is a flow chart showing the steps involved in fault diagnostics procedures for the transportation means mounted with the display apparatus according to the embodiment of the present invention. ST$^{xxx}$ represents a step number.

ST201: The fuel injection (FI) warning mark 78*d* lights steadily, which allows the operator to know that a fault has occurred in the fuel injection system 61 (see FIG. 4).

ST202: Diagnostics procedures are performed. More specifically, the set switch 73*a* and the mode switch 73*b* of the display apparatus 70 are simultaneously pressed and held down for a while.

A specific faulty spot can be known quickly in this case if, for example, the warning lamp 72 flashes off and on once to indicate that the vacuum of the intake passageway 63 (see FIG. 4) is faulty, the warning lamp 72 flashes off and on three times to indicate that the fuel pump (not shown) is faulty, and the warning lamp 72 flashes off and on twice to indicate that the throttle cable 47 (see FIG. 2) is faulty.

ST203: The fault diagnostics mode is canceled. More specifically, the mode switch 73*b* is pressed, or the mode is automatically canceled after the lapse of 30 seconds if there are no signal inputs.

The display apparatus 70 is provided, in the multifunctional display portion 78 thereof, with the warning mark 78*d* that warns that a fault has occurred in the fuel injection system 61. The mark 78*d* is made to steadily light or flash off and on to emphasize that the fault is in the fuel injection system. The display apparatus is also provided with the function to indicate the corresponding faulty symptom by means of a flashing pattern (for example, the warning lamp 72 flashes off and on once, twice, three time, or the like) given when the operation switches 73 are operated as the warning mark 78*d* lights steadily or flashes off and on. The transportation means (jet propulsion watercraft 10) is provided with the multifunctional display portion 78 that displays operating information and various types of warning conditions. Operation switches 73 are used for operating the display contents of the multifunctional display portion 78. The fuel injection system 61 (see FIG. 4) injects fuel for the driving source, The fuel injection system is generally a device that mixes air with fuel and vaporizes a mixture of air and fuel to supply the mixture to an engine. If, for example, the fuel injection system develops a malfunction, it is difficult to determine whether the fault is attributable to the air intake system, the fuel supply system, or any other system.

The warning mark 78*d* is therefore provided to warn that a fault has occurred in the fuel injection system 61 (see FIG. 4) 50 that a fault in the fuel injection system 61 can be notified. The warning mark 78*d* is made to light steadily or flash off and on so as to emphasize that the fault is present in the fuel injection system 61. Furthermore, the function is provided that indicates the corresponding faulty symptom by means of a flashing pattern given to the warning lamp 72 when the operation switches 73 are operated as the warning mark 78*d* lights steadily or flashes off and on, which allows a prompt action to be taken against a malfunction of the fuel injection system 61.

Namely, the function provided for indicating the corresponding faulty symptom by means of the flashing pattern given to the warning lamp 72 when the operation switches 73 are operated as the warning 78*d* lights steadily or flashes off and on enhances the convenience in eliminating malfunctions of the fuel injection system 61.

Figure 13:
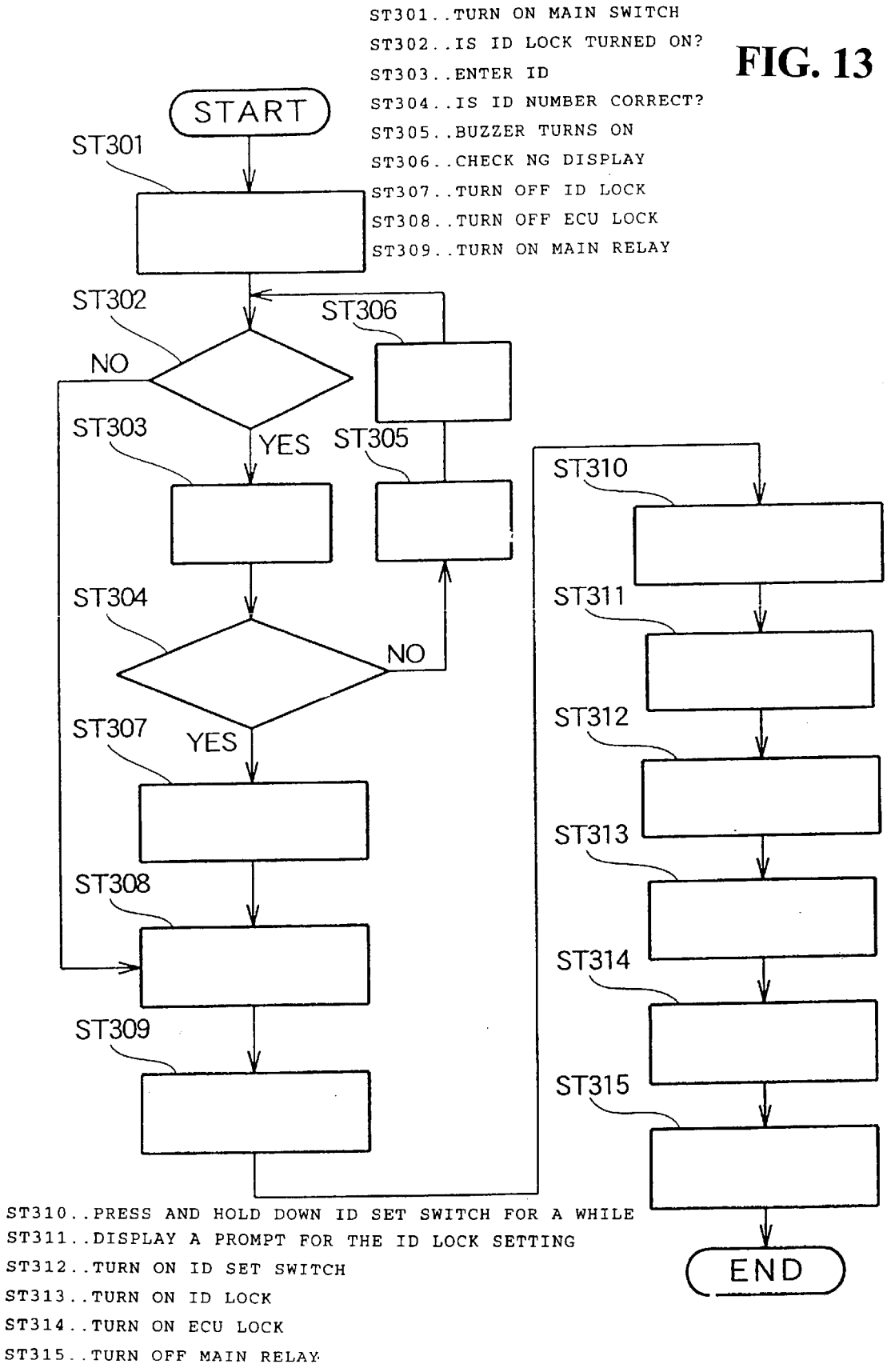
FIG. 13 is a flow chart showing steps for locking and unlocking the anti-theft function for the transportation means mounted with the display apparatus according to the present invention.

FIG. 13 is a flow chart showing the steps for locking and unlocking the anti-theft function for the transportation means mounted with the display apparatus according to the embodiment of the present invention (see FIG. 7 for reference numerals). ST$^{xxx}$ represents a step number.

ST301: The main switch 45 is turned ON.

ST302: It is determined whether or not the ID lock (anti theft function) has been turned ON. If it is answered YES, the operation proceeds to ST303. If it is answered NO, the operation proceeds to ST308.

ST303: The ID number is entered using the ID number switch 73*d*. The permissible number of times the ID number can be entered has been set to three. That is, the power for the display apparatus 70 (see FIG. 4) is shut down if an illegal ID number has been entered three times.

ST304: It is determined whether or not the ID number is correct. If it is answered YES, the operation proceeds to ST307 and, if it is answered NO, the operation returns to ST302 by way of ST305 and ST306.

ST305: A buzzer warning is given.

ST306: A display indicating that the ID number has been found to be wrong as a result of checking (check NG display) is given. Namely, the ID number mark 78*h* (see FIG. 5), the key mark 78*i*, and the number entered are flashed off and on.

ST307: The ID lock is canceled.

ST308: The control portion (ECU) 101 is unlocked.

ST309: The main relay 91 is turned ON. The display apparatus 70 (see FIG. 4) is shut down in this condition. The procedure involved in turning ON the ID lock will be explained in the following.

ST310: The ID set switch 73*c* is pressed and held down for a while. The period of time through which the switch is held down is set to 2 sec. or longer.

ST311: A prompt indicating that the system is waiting for the ID lock to be set is displayed on the display apparatus 70.

ST312: The ID set switch 73*c* is pressed.

ST313: The ID lock is turned ON.

ST314: The control portion (ECU) 101 is locked, disabling the display apparatus 70 (see FIG. 4).

ST315: The main relay 91 is turned OFF.

Figure 14A:
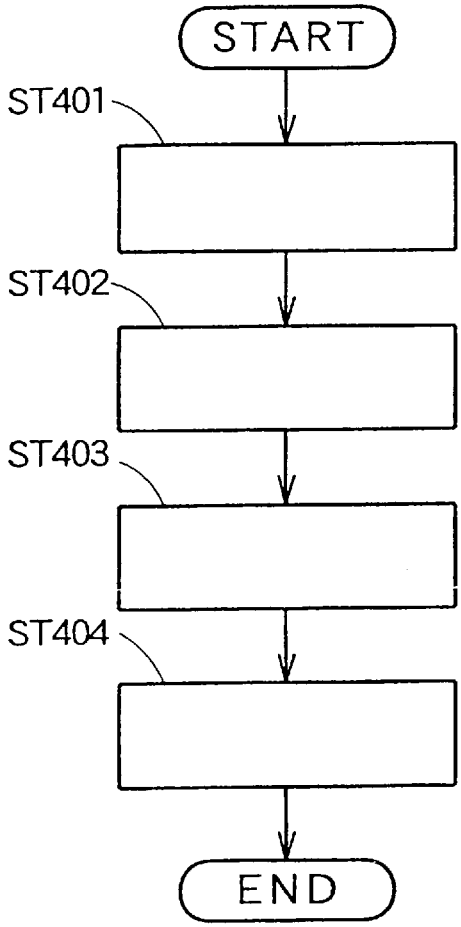
FIGS. 14(*a*) and 14(*b*) are flow charts showing steps for newly programming an ID and forcing to reset the ID of the anti-theft function for the transportation means mounted with the display apparatus according to the present invention.
Figure 14B:
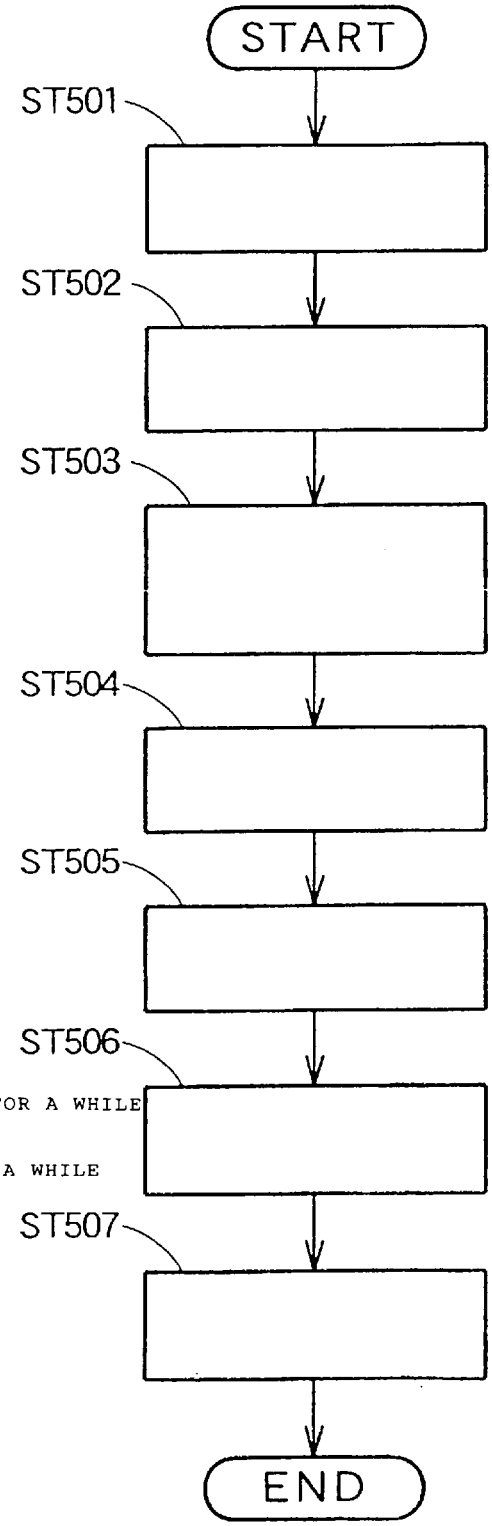

FIGS. 14(*a*) and 14(*b*) are flow charts showing the steps for newly programming an ID and forcing to reset the ID of the anti-theft function for the transportation means mounted with the display apparatus according to the embodiment of the present invention (see FIG. 5 for reference numerals). ST$^{xxx}$ represents a step number.

FIG. 14(*a*) shows the procedure involved in newly programming an ID for the ID lock (anti-theft function).

ST401: The main switch 45 (see FIG. 7) is turned ON.

ST402: The ID number switch 73*d* is pressed and held down for a while. The period of time through which the switch is held down is set to 2 sec. or longer.

ST403: The ID number is entered using the ID number switch 73*d*.

ST404: The ID set switch 73*c* is pressed and held down for a while so that the ID number is newly registered with the system. The period of time through which the switch is held down is set to 2 sec. or longer.

The procedure is completed after going through the steps of ST309 through ST312 shown in FIG. 13.

FIG. 14(*b*) shows the procedure involved in forcing to reset the ID for the ID lock (anti-theft function).

ST501: A fuel signal is set to an open state. Namely, a harness from a fuel sensor (not shown) of the fuel injection system 61 is disconnected. For example, one of harnesses 87*a*, 87*b* shown in FIG. 6 is disconnected.

ST502: The main switch 45 (see FIG. 7) is turned ON.

ST503: The set switch 73*a* and the mode switch 73*b* are simultaneously pressed and held down for a while. The period of time through which the switches are held down is set to 5 seconds.

ST504: A reset number as a predetermined number is entered using the ID number switch 73*d*. The reset number is a number predetermined when the watercraft was manufactured, such as the hull number or the like.

ST505: The ID number is reset. When the ID number is reset to the initial value of "000," the ID lock can no longer be turned ON. The ID number must be entered again.

ST506: The main switch 45 is turned OFF.

ST507: The fuel signal is set to a closed state. Namely, the disconnected harness is reconnected.

That is, performing the steps from ST501 through ST505 allows the ID number to be reset.

If the ID number is to be used anew, it must be registered once again.

The method for resetting the ID number for the anti-theft function employed in the transportation means (jet propulsion watercraft 10) is an arrangement, in which, in a transportation means provided with an anti-theft function that allows the power to be turned ON when the operator enters an ID number, the ID number can be reset by entering a predetermined number (a reset number) with at least one of the plurality of harnesses 87*a*, 87*b* (see FIG. 6) connected to the anti-theft function disconnected therefrom.

For example, if an operator or an owner runs into an unexpected situation, in which he or she is unable to remember the ID number and such a situation is corrected by replacing the entire anti-theft function, it costs the operator or the owner an inordinate amount of repair charges. If the ID number can be easily reset, on the other hand, the anti-theft function cannot be maintained.

Since the arrangement is provided, in which the ID number can be reset if at least one of the plurality of harnesses 87*a*, 87*b* (see FIG. 6) connected to the anti-theft function is disconnected therefrom and, in that condition, the predetermined number is entered, it is possible to take appropriate action against the unexpected situation and, at the same time, maintain the anti-theft function.

Figure 15:
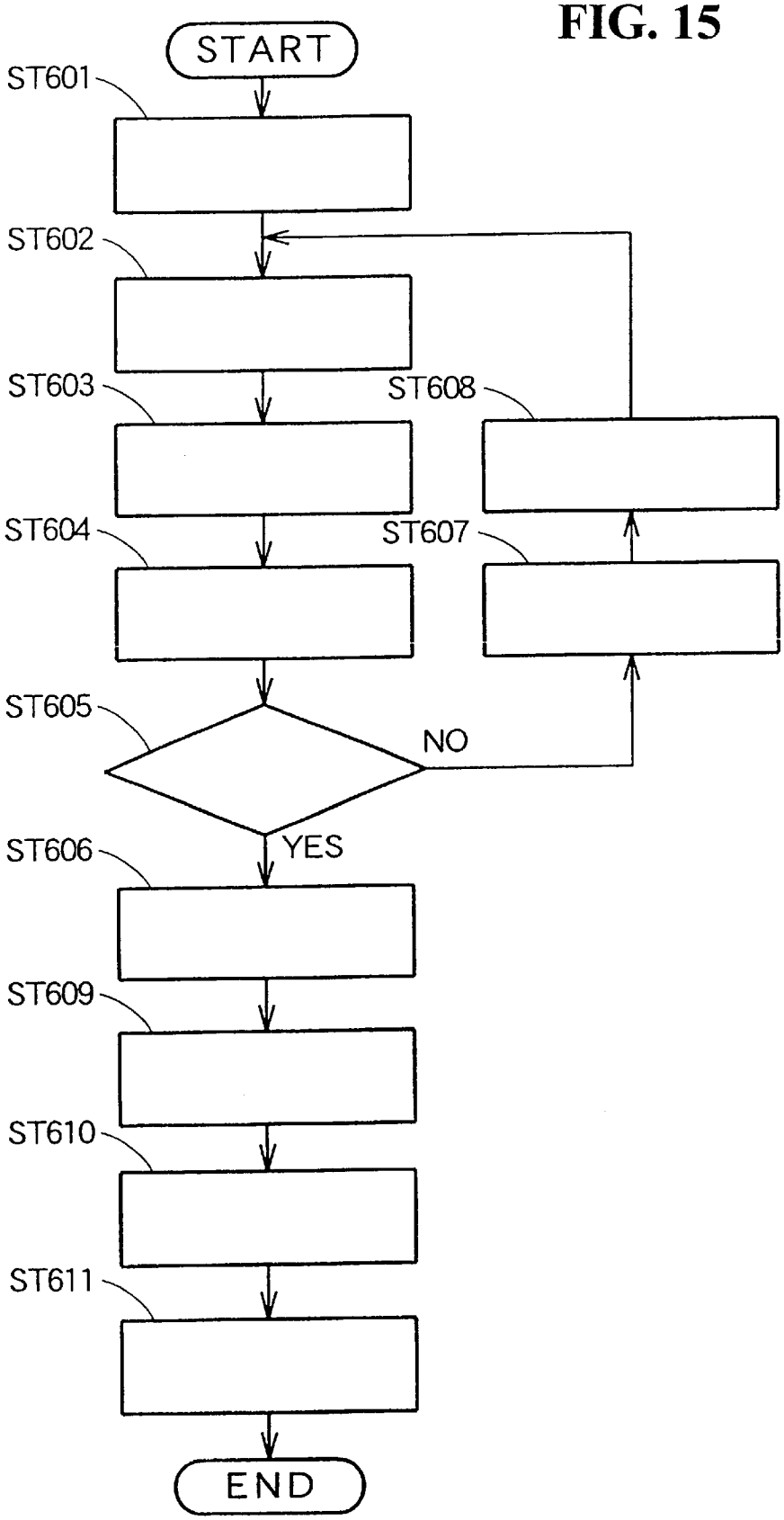
FIG. 15 is a flow chart showing steps for changing a registered ID number for the anti-theft function for the transportation means mounted with the display apparatus according to present invention.

FIG. 15 is a flow chart showing steps for changing a registered ID number for the anti-theft function for the transportation means mounted with the display apparatus according to the embodiment of the present invention (see FIG. 5 for reference numerals). ST$^{xxx}$ represents a step number.

ST601: The ID number switch 73*d* is pressed and held down for a while. The period of time through which the switch is held down is set to 2 seconds or longer.

ST602: The ID number previously registered with the system is entered.

ST603: The ID number entered flashes off and on.

ST604: The ID set switch 73*c* is pressed and held down for a while. The period of time through which the switch is held down is set to 2 sec. or longer.

ST605: It is determined whether or not the ID number entered is correct. If it is answered YES, the operation proceeds to ST506, and if it is answered NO, the operation returns to ST602 by way of ST607 and ST608. The permissible number of times the ID number can be entered has been set to three. That is, the power for the display apparatus 70 (see FIG. 4) is shut down if an illegal ID number has been entered three times.

ST606: A new ID number is entered.

ST607: A buzzer warning is given.

ST608: A display indicating that the ID number has been found to be wrong as a result of checking (check NG display) is given. Namely, the ID number mark 78*h* (see FIG. 5), the key mark 78*i*, and the number entered are flashed off and on.

ST609: The new ID number is flashed off and on.

ST610: The ID set switch 73*c* is pressed and held down for a while. The period of time through which the switch is held down is set to 2 sec. or longer.

ST611: The new ID number is lit steadily to indicate that the procedure to register the new ID number has been completed.

Figure 16:
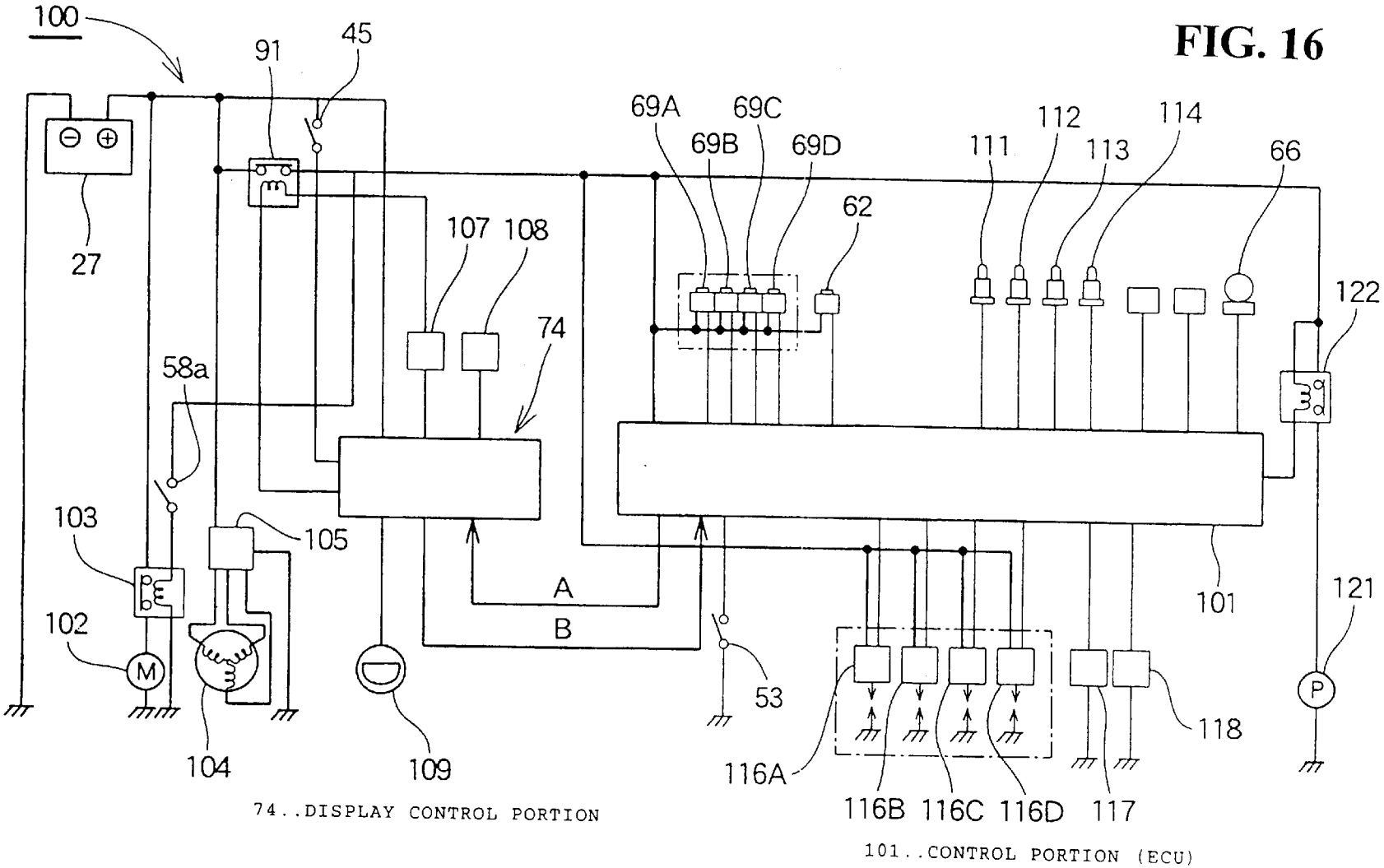
FIG. 16 is a control system diagram for the transportation means mounted with the display apparatus according to the present invention.

FIG. 16 is a control system diagram for the transportation means mounted with the display apparatus according to the embodiment of the present invention.

A small watercraft control system 100 is provided with such major components as the battery 27 serving as the power source, the injector 69 (shown as "injectors 69A to 69D" in FIG. 16) of the fuel injection system 61 (see FIG. 4), the main relay 91, the display control portion 74 mounted in the display apparatus 70 (see FIG. 5), and the control portion (ECU) 101 controlling the engine 15 (see FIG. 1).

Referring to FIG. 16, reference numeral 102 represents a starter. Reference numeral 103 represents a starter relay that turns the starter 102 ON or OFF. Reference numeral 104 represents a generator. Reference numeral 105 represents a regulator that regulates a voltage generated by the generator. Reference numeral 107 represents a buzzer connected to the display control portion 74. Reference numeral 108 represents a speed sensor connected to the display control portion 74. Reference numeral 109 represents a fuel sensor connected to the display control portion 74. Reference numeral 111 represents a temperature sensor connected to the control portion (ECU) 101. Reference numeral 112 represents a coolant sensor connected to the control portion (ECU) 101. Reference numeral 113 represents a exhaust temperature detecting sensor connected to the control portion (ECU) 101. Reference numeral 114 represents an oil temperature sensor that detects the temperature of the engine oil through connection thereof to the control portion (ECU) 101. Reference numerals 116A to 116D represent ignition system members (ignition plugs and ignition coils). Reference numeral 117 represents an oil pressure sensor. Reference numeral 118 represents a detonation sensor that detects detonation of the engine 15. Reference numeral 121 represents a fuel pump. Reference numeral 122 represents a relay that turns the fuel pump ON or OFF.

The flow indicated by the arrow A represents engine oil information, temperature information, fuel information, engine speed information, warning lamp display information, and OTS (Off Throttle Steering System) information sent from the control portion (ECU) 101 to the display control portion 74.

The flow indicated by the arrow B, on the other hand, represents lock information and limited operation information sent from the display control portion 74 to the control portion (ECU) 101.

It is to be noted that, according to the preferred embodiment explained in the above, the symptom is indicated by a flashing pattern of the warning lamp (for example, the lamp flashes off and on once, twice, three times, or the like) as shown in FIG. 12. The indication method is not limited to this arrangement; rather, the symptom may be indicated by a buzzer sounding, in addition to a warning lamp that lights steadily, or only by a buzzer sounding.

The invention according to the present invention as described above offers the following effects.

The fuel injection system is generally a device that mixes air with fuel and vaporizes a mixture of air and fuel to supply the mixture to the engine. If, for example, the fuel injection system develops a malfunction, it is difficult to determine whether the fault is attributable to the air intake system, the fuel supply system, or any other.

According to the first aspect of the present invention, the warning mark that warns that a fault has occurred in the fuel injection system is provided in the multifunctional display portion, the warning mark is made to light steadily or flash off and on. In addition, the function that indicates the corresponding faulty symptom by means of a flashing pattern given to a warning lamp when the operation switches are operated as the warning mark lights steadily or flashes off and on is provided. Accordingly, a prompt action can be taken against a malfunction of the fuel injection system. As a result, convenience in eliminating malfunctions of the fuel injection system can be enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A display apparatus for transportation means, the transportation means being provided with a multifunctional display portion that displays operating information and various types of warning conditions, operation switches that operate information displayed in the multifunctional display portion, and a fuel injection system that injects fuel for a driving source, said display apparatus comprising:

a warning mark provided in the multifunctional display portion, said warning mark warning of a faulty condition developing in the fuel injection system, said warning mark being provided a function that causes the warning mark to light steadily or flash off and on; and a warning lamp, said warning lamp indicating a faulty symptom by means of a flashing on and off pattern of the warning lamp when the operation switches are operated while the warning mark is lit steadily or flashing off and on.

2. The display apparatus for transportation means according to claim 1, wherein said warning lamp flashes on and off once to indicate that vacuum of an intake passageway of the transportation means is faulty.

3. The display apparatus for transportation means according to claim 1, wherein said warning lamp flashes on and off twice to indicate that a throttle cable of the transportation means is faulty.

4. The display apparatus for transportation means according to claim 1, wherein said warning lamp flashes on and off three times to indicate that a fuel pump of the transportation means is faulty.

5. Transportation means, comprising:

a body;

an engine, said engine being supported by said body;

a fuel injection system, said fuel injection system injecting fuel into said engine;

a multifunctional display portion, said multifunctional display portion displaying operating information and various types of warning conditions, said multifunctional display portion including a warning mark provided therein, said warning mark warning of a faulty condition developing in the fuel injection system, said warning lamp being provided with a function that causes the warning mark to light steadily or flash off and on; and a warning lamp, said warning lamp indicating a faulty symptom by means of a flashing on and off pattern of the warning mark when the operation switches are operated while the warning mark is lit steadily or flashing off and on; and operation switches, said operating switches operating information displayed in said multifunctional display portion.

6. The transportation means according to claim 5, wherein said warning lamp flashes on and off once to indicate that vacuum of an intake passageway of the transportation means is faulty.

7. The transportation means according to claim 5, wherein said warning lamp flashes on and off twice to indicate that a throttle cable of the transportation means is faulty.

8. The transportation means according to claim 5, wherein said warning lamp flashes on and off three times to indicate that a fuel pump of the transportation means is faulty.

9. The transportation means according to claim 5, wherein said transportation means is a jet propulsion boat.

10. A display apparatus for transportation means, comprising:

a multifunctional display portion, said multifunctional display portion including:

a warning mark provided therein, said warning mark warning of a faulty condition developing in a fuel injection system of the transportation means, said warning mark being provided with a function that causes the warning lamp to light steadily or flash off and on; and a warning lamp, said warning lamp indicating a faulty symptom by means of a flashing on and off pattern of the warning lamp when operation switches of the transportation means are operated while the warning mark is lit steadily or flashing off and on.

11. The display apparatus for transportation means according to claim 10, wherein said warning lamp flashes on and off once to indicate that vacuum of an intake passageway of the transportation means is faulty.

12. The display apparatus for transportation means according to claim 10, wherein said warning lamp flashes on and off twice to indicate that a throttle cable of the transportation means is faulty.

13. The display apparatus for transportation means according to claim 10, wherein said warning lamp flashes on and off three times to indicate that a fuel pump of the transportation means is faulty.

* * * * *